US010342273B2

(12) United States Patent
Cai et al.

(10) Patent No.: US 10,342,273 B2
(45) Date of Patent: Jul. 9, 2019

(54) GLOVE

(71) Applicant: GUANGXI XI NUO SHENG GLOVE CO., LTD., Nanning, Guangxi (CN)

(72) Inventors: Wenlan Cai, Nanning (CN); Zhibin Li, Nanning (CN); Ning Li, Nanning (CN)

(73) Assignee: Guangxi Xi Nuo Sheng Glove Co., Ltd., Nanning, Guangxi (CN)

( * ) Notice: Subject to any disclaimer, the term of this patent is extended or adjusted under 35 U.S.C. 154(b) by 281 days.

(21) Appl. No.: 15/035,939

(22) PCT Filed: Nov. 7, 2014

(86) PCT No.: PCT/CN2014/090528

§ 371 (c)(1),
(2) Date: May 11, 2016

(87) PCT Pub. No.: WO2015/070728

PCT Pub. Date: May 21, 2015

(65) Prior Publication Data

US 2016/0295941 A1 Oct. 13, 2016

(30) Foreign Application Priority Data

Nov. 12, 2013 (CN) ..... 2013 1 0560492
Nov. 12, 2013 (CN) ..... 2013 1 0560501
(Continued)

(51) Int. Cl.
*A41D 19/00* (2006.01)
*A41D 19/015* (2006.01)
*A41D 19/02* (2006.01)

(52) U.S. Cl.
CPC ..... *A41D 19/01505* (2013.01); *A41D 19/00* (2013.01); *A41D 19/001* (2013.01);
(Continued)

(58) Field of Classification Search
CPC .... A41D 19/00; A41D 19/002; A41D 19/015; A63B 71/148
See application file for complete search history.

(56) References Cited

U.S. PATENT DOCUMENTS 5,345,609 A * 9/1994 Fabry ..... A41D 19/01523 2/161.1
5,715,539 A 2/1998 Benecki et al.
(Continued)

FOREIGN PATENT DOCUMENTS

CA 2809410 A1 3/2012
CN 1116073 A 2/1996
(Continued)

OTHER PUBLICATIONS

"Ropes & Equipment for Your Vertical World," *PMI*, 2012, Catalog No. 212, http://www.wfrfire.com/rappell/PMIcatalogue_2012.pdf, 116 pages, Pigeon Mountain Industries, Inc.
(Continued)

*Primary Examiner* — Tajash D Patel
(74) *Attorney, Agent, or Firm* — Muncy, Geissler, Olds & Lowe, P.C.

(57) ABSTRACT

A glove includes a glove core and a glove component. The glove core includes a palm portion, a dorsum portion and a side portion of hand. A side of the glove component is adhered on a surface of the glove core, and the glove component covers a part of the palm portion and a part of the dorsum portion of the glove core, a part of the palm portion and a part of the side portion of hand of the glove core, or a part of the dorsum portion and a part of the side portion of hand of the glove core, such that the glove core can be combined with the enhanced glove component, forming a structure which is simple in structure and can be formed easily. Furthermore, the robustness of the glove can be
(Continued)

improved significantly to be provided with practicability and progressiveness.

17 Claims, 27 Drawing Sheets

(30) Foreign Application Priority Data

| | | |
|---|---|---|
| Nov. 12, 2013 | (CN) | 2013 1 0560503 |
| Nov. 12, 2013 | (CN) | 2013 1 0561245 |
| Nov. 12, 2013 | (CN) | 2013 2 0711864 |
| Nov. 12, 2013 | (CN) | 2013 2 0711865 |
| Nov. 12, 2013 | (CN) | 2013 2 0712624 |
| Nov. 12, 2013 | (CN) | 2013 2 0712636 |
| May 28, 2014 | (CN) | 2014 1 0230373 |
| May 28, 2014 | (CN) | 2014 2 0278506 |
| Nov. 4, 2014 | (CN) | 2014 2 0653787 |

(52) U.S. Cl.
CPC ..... *A41D 19/0006* (2013.01); *A41D 19/0051* (2013.01); *A41D 19/0096* (2013.01); *A41D 19/02* (2013.01); *A41D 2300/52* (2013.01)

(56) References Cited

U.S. PATENT DOCUMENTS

| | | | | |
|---|---|---|---|---|
| 6,098,200 | A * | 8/2000 | Minkow | A41D 19/01523 2/161.1 |
| 8,312,563 | B1 * | 11/2012 | Burns | A41D 19/01 2/16 |
| 9,211,468 | B2 * | 12/2015 | Bruce | A63B 71/146 |
| 9,302,171 | B1 * | 4/2016 | Iacono | A63B 71/146 |
| 2003/0217403 | A1 | 11/2003 | Hatch et al. | |
| 2005/0183184 | A1 | 8/2005 | Hatch et al. | |
| 2008/0109934 | A1 * | 5/2008 | Widdemer | A41D 19/01523 2/159 |
| 2009/0075019 | A1 | 3/2009 | Loos | |
| 2011/0197896 | A1 | 8/2011 | Liou | |
| 2013/0007937 | A1 * | 1/2013 | Stone | A41D 13/081 2/16 |
| 2014/0059739 | A1 * | 3/2014 | Gellis | A41D 19/015 2/168 |

FOREIGN PATENT DOCUMENTS

| | | | |
|---|---|---|---|
| CN | 202311312 | U | 7/2012 |
| CN | 103035942 | A | 4/2013 |
| CN | 103435942 | A | 1/2014 |
| CN | 103535941 | A | 1/2014 |
| CN | 103549679 | A | 2/2014 |
| CN | 203575684 | U | 5/2014 |
| CN | 204015194 | U | 12/2014 |
| GB | 2028632 | A | 3/1980 |
| KR | 20010020778 | A | 3/2001 |
| WO | WO2007/040692 | A1 | 4/2007 |

OTHER PUBLICATIONS

An Office Action dated Sep. 13, 2016 in corresponding AU Application No. 2014350789 is attached (3 pages).
A European Search Report dated Mar. 29, 2017 in corresponding EP Application No. 14861769 is attached (8 pages).
An Office Action dated Nov. 4, 2015 in corresponding CN Application No. 201410230373.8 is attached (10 pages).
An Office Action dated May 13, 2016 in corresponding CN Application No. 201410230373.8 is attached (6 pages).
An Office Action dated Nov. 23, 2016 in corresponding CN Application No. 201410230373.8 is attached (6 pages).
An Office Action dated Apr. 26, 2017 in corresponding CA Application No. 2,930,340 is attached (3 pages).

* cited by examiner

GLOVE

BACKGROUND OF THE INVENTION a) Field of the Invention

The present invention relates to a glove, and more particularly to a glove which is simple in structure and can be formed easily, as well as is provided with significantly improved robustness.

b) Description of the Prior Art

An existing glove is generally divided into a cloth glove, a plastic glove and an asbestos glove, depending on the material thereof; whereas, the present invention aims to improve the cloth glove, a yarn glove or a leather glove.

Upon practically using the existing cloth glove, it is found that as the cloth glove is formed by interweaving plural fiber wires, there is a seam between every two fiber wires and thus when a person who wears the cloth glove is carrying out some works, some sharp and tiny foreign objects can easily penetrate the seams in the cloth glove to injure hand skin.

On the other, although some vendors have already covered a rubber layer on a proper area of the outer cloth on the cloth glove, primarily a specific location, such as a finger portion, a palm portion or a dorsum portion. These portions are sewn individually with the rubber layer which is combined on the outer cloth of the cloth glove, and sufficient protection is given to the hand corresponding to the change in curvature on the hand, thereby achieving a purpose of providing protection locally.

However, in making the existing gloves, these protection layers are sewn on the cloth gloves one by one, and therefore, a lot of time and labor works will be spent in manufacturing. In addition, it can easily result in a mistake in the sewing positions when the protection layers are sewn manually and the protection effect to the gloves will be reduced if the sewing positions are not accurate enough to match the curvature on the hand.

SUMMARY OF THE INVENTION

Accordingly, the primary object of the present invention is to provide a glove, and more particularly to a glove which is simple in structure and can be formed easily, as well as is provided with significantly improved robustness.

To achieve the abovementioned object, the glove of the present invention includes a glove core and at least a glove component. The glove core is provided with at least a palm portion, a dorsum portion and a side portion of hand, wherein a side of the glove component is adhered on a surface of the glove core, the glove component covers at least a part of the palm portion and at least a part of the dorsum portion of the glove core, at least a part of the palm portion and at least a part of the side portion of hand of the glove core, or at least a part of the dorsum portion and at least a part of the side portion of hand of the glove core, such that by combining the glove core with the enhanced glove component, the glove of the present invention is simple in structure and can be formed easily, as well as is provided with significantly improved robustness, thereby being provided with practicability and progressiveness.

The present invention also discloses a glove which includes a glove core and at least a glove component. The glove core includes at least a palm portion, a dorsum portion and a finger portion, wherein a side of the glove component is adhered on a surface of the glove core, the glove component covers at least a part of the palm portion or at least a part of the dorsum portion of the glove core, at least a part of the finger portion, or at least a part of the palm portion and at least a part of the dorsum portion of the glove core as well as at least a part of the finger portion.

According to the abovementioned technical features, the said finger portion further includes a thumb sleeve, an index finger sleeve, a middle finger sleeve, a ring finger sleeve, a little finger sleeve, a web space disposed between the thumb sleeve and the index finger sleeve, and three fork portions disposed among the index finger sleeve, the middle finger sleeve, the ring finger sleeve and the little finger sleeve.

According to the abovementioned technical features, the said finger portion further includes a finger face portion, a fourchette portion and a finger dorsum portion which are disposed on the thumb sleeve, the index finger sleeve, the middle finger sleeve, the ring finger sleeve and the little finger sleeve, respectively.

Each tail end of the abovementioned thumb sleeve, index finger sleeve, middle finger sleeve, ring finger sleeve, and little finger sleeve is provided with an opening.

According to the abovementioned technical features, the said glove component covers the web space and at least a part of the fork portions sewn on a surface of the glove core.

According to the abovementioned technical features, the said glove further includes at least an adhesive layer disposed between the glove core and the glove component to adhere the two.

According to the abovementioned technical features, an upper side of the said glove core, not being covered by the glove component, is provided with at least a protection layer.

According to the abovementioned technical features, another side of the said glove component is combined with at least a protection layer.

According to the abovementioned technical features, the said glove component is provided with at least a decoration portion.

According to the abovementioned technical features, the glove components include at least a first glove component and a second glove component. The first glove component is provided with a first inner surface and a first outer surface opposite to the first inner surface; whereas, the second glove component is provided with a second inner surface and a second outer surface opposite to the second inner surface. The second inner surface is adhered on the first outer surface by a combination region.

According to the abovementioned technical features, the glove components include at least a first glove component and a second glove component. The first glove component is provided with a first inner surface and a first outer surface opposite to the first inner surface; whereas, the second glove component is provided with a second inner surface and a second outer surface opposite to the second inner surface. The first inner surface and the second inner surface form a holding space, and the second inner surface is adhered on the first outer surface by a combination region.

According to the abovementioned technical features, the first glove component and the second glove component are connected together by a connection portion.

According to the abovementioned technical features, the glove component includes at least a first glove component, a second glove component and a third glove component. The third glove component is adhered with the first glove component or the second glove component by a combination region.

According to the abovementioned technical features, the glove component includes at least a first glove component, a second glove component and a third glove component. The first glove component is provided with a first inner surface and a first outer surface opposite to the first inner surface; whereas, the second glove component is provided with a second inner surface and a second outer surface opposite to the second inner surface. The first inner surface and the second inner surface form a holding space, and the third glove component is adhered with the first glove component or the second glove component by a combination region.

According to the abovementioned technical features, the glove components include at least a first glove component and a second glove component. The first glove component is provided with a first inner surface, a first outer surface opposite to the first inner surface, and a first cross section disposed between the first inner surface and the first outer surface; whereas, the second glove component is provided with a second inner surface, a second outer surface opposite to the second inner surface, and a second cross section disposed between the second inner surface and the second outer surface. The first cross section is adhered with the second cross section by a combination region.

According to the abovementioned technical features, the first glove component is a palm portion and the second glove component is a dorsum portion, or the first glove component is a dorsum portion and the second glove component is a palm portion.

According to the abovementioned technical features, the first glove component is provided with at least a garment section, or the second glove component is provided with at least a garment section.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1A:
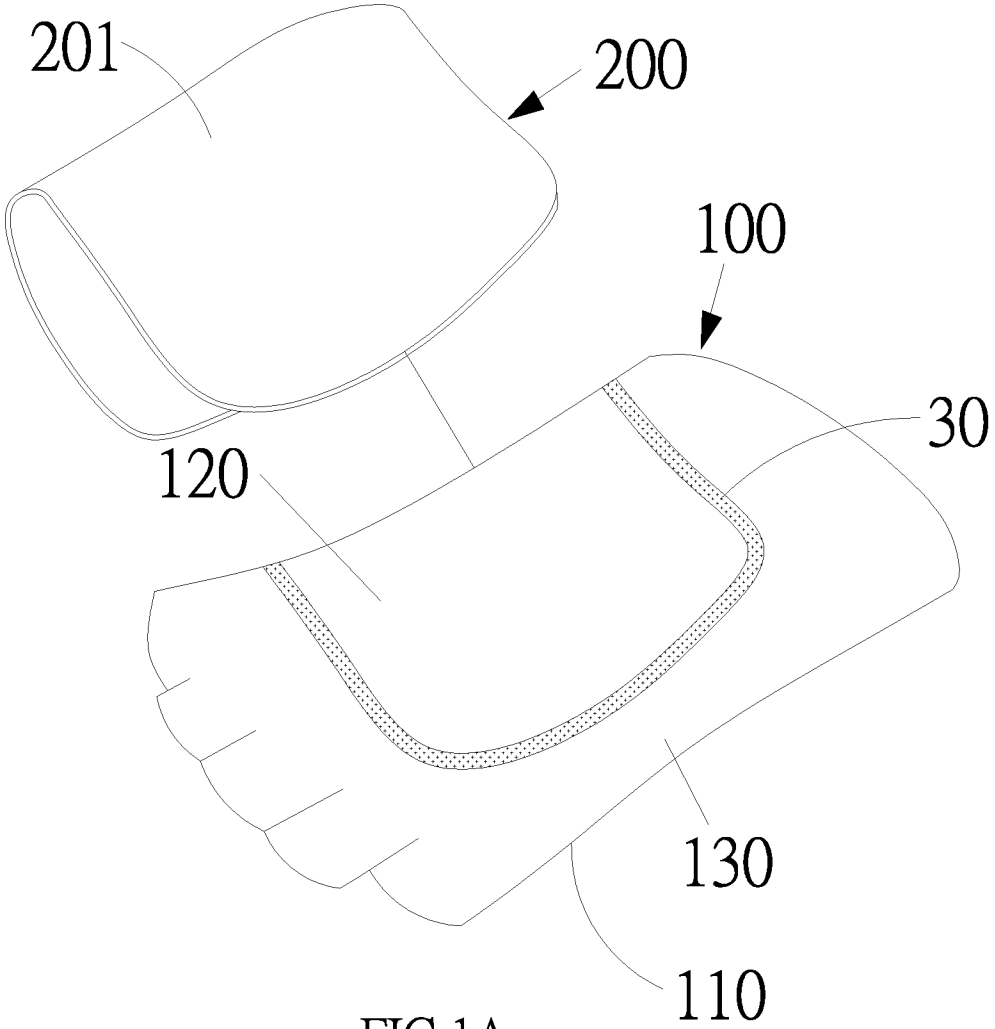
FIG. 1A shows a structural schematic view of a first embodiment of a glove, according to the present invention.
Figure 1B:
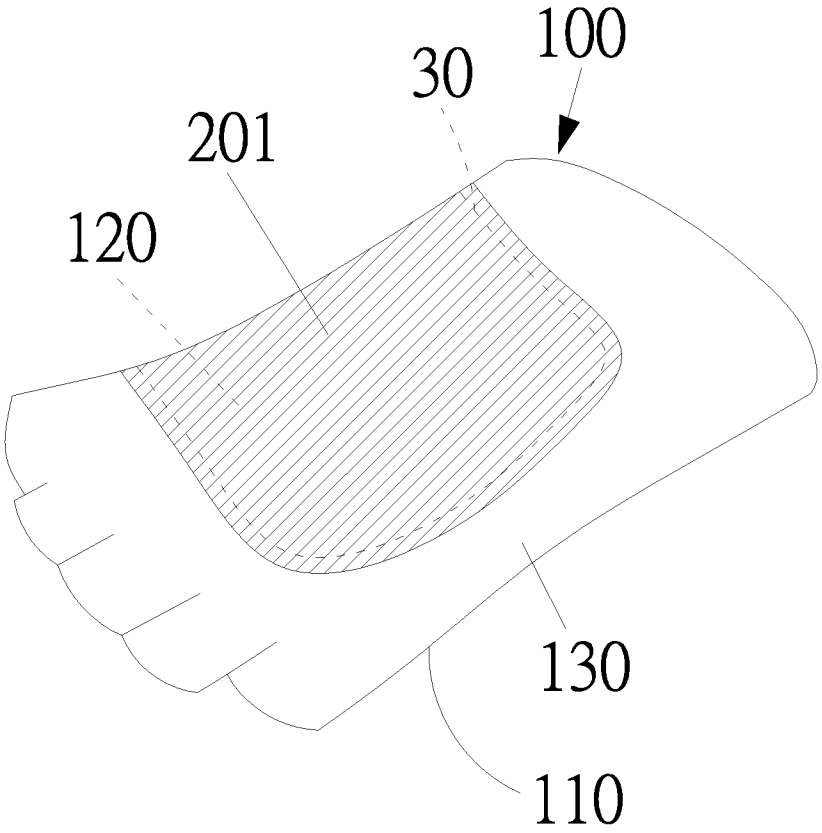
FIG. 1B shows another structural schematic view of the first embodiment of the glove, according to the present invention.

Referring to FIG. 1A and FIG. 1B, it shows structural schematic views of a first embodiment of a glove, according to the present invention. The glove of the present invention comprises a glove core 100 and at least a glove component 200. The glove core 100 includes at least a palm portion 110, a dorsum portion 120 and a side portion 130 of hand. The glove core 100 can be a knitted glove core or a sewn glove core, wherein the knitted glove core is a 6-stitch, 7-stitch, 8-stitch, 9-stitch, 10-stitch, 11-stitch, 12-stitch, 13-stitch, 14-stitch, 15-stitch, 16-stitch, 17-stitch, 18-stitch or 19-stitch knitted glove core.

The glove component 200, on the other hand, can be made of PVC (Polyvinylchloride), leather cashmere, fiber artificial leather, pig full grain leather, pig split leather, pig suede leather, cow full grain leather, cow split leather, cow suede leather, sheep full grain leather, sheep suede leather, horse hide or buckskin. As the embodiment shown in the drawings, the glove component 200 is provided with a half palm portion 201 which is provided with a palm face.

A side of the half palm portion 201 in the glove component 200 is adhered on a surface of the glove core 100, and the half palm portion 201 in the glove component 200 covers at least a part of the palm portion 110 and at least a part of the dorsum portion 120 of the glove core 100. In other words, the half palm portion 201 covers at least a part of the palm portion 110 of the glove core 100, and covers back at least a part of the dorsum portion 120 of the glove core 100, forming a three-dimensional configuration to comply with the ergonomic principle. The abovementioned adhering method includes the provision of at least an adhesive layer 30 on an edge of the half palm portion 201 or an edge of the glove core 100. The adhesive layer 30 can be made of a viscous interface material, such as PU (Polyurethane) or acrylate, and can be attached on the edge by patching with an adhesive film or coating with glue, forming the adhesion and the fixation to the half palm portion 201 and the glove core 100. It is naturally that the half palm portion 201 and the glove core 100 can be also adhered and fixed together by a high-frequency wave or a pressing method.

Figure 2:
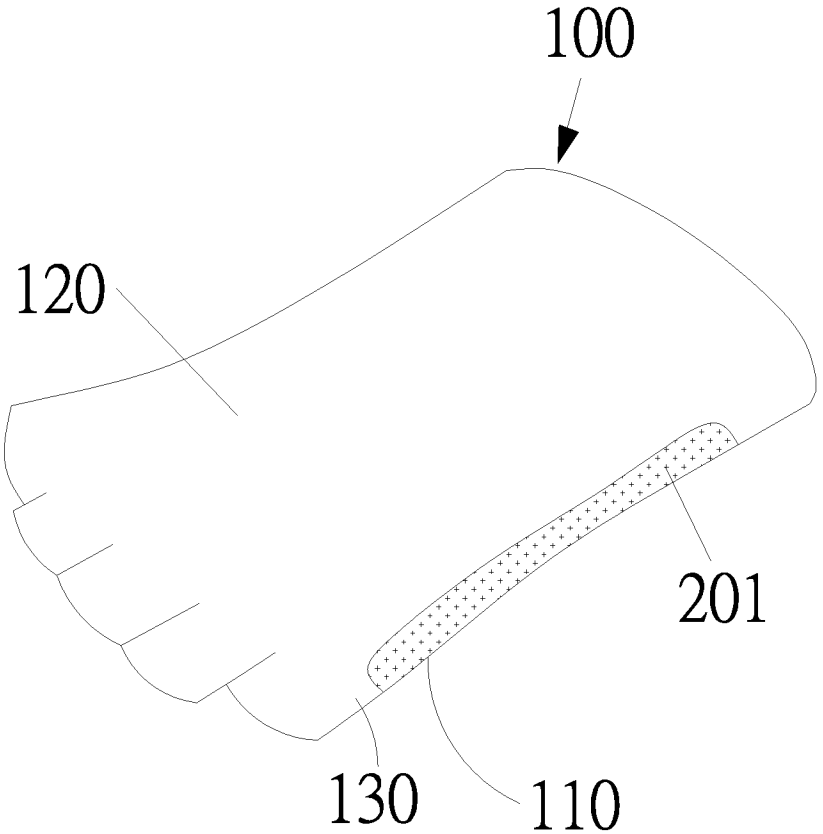
FIG. 2 shows a structural schematic view of a second embodiment of the glove, according to the present invention.
Figure 3:
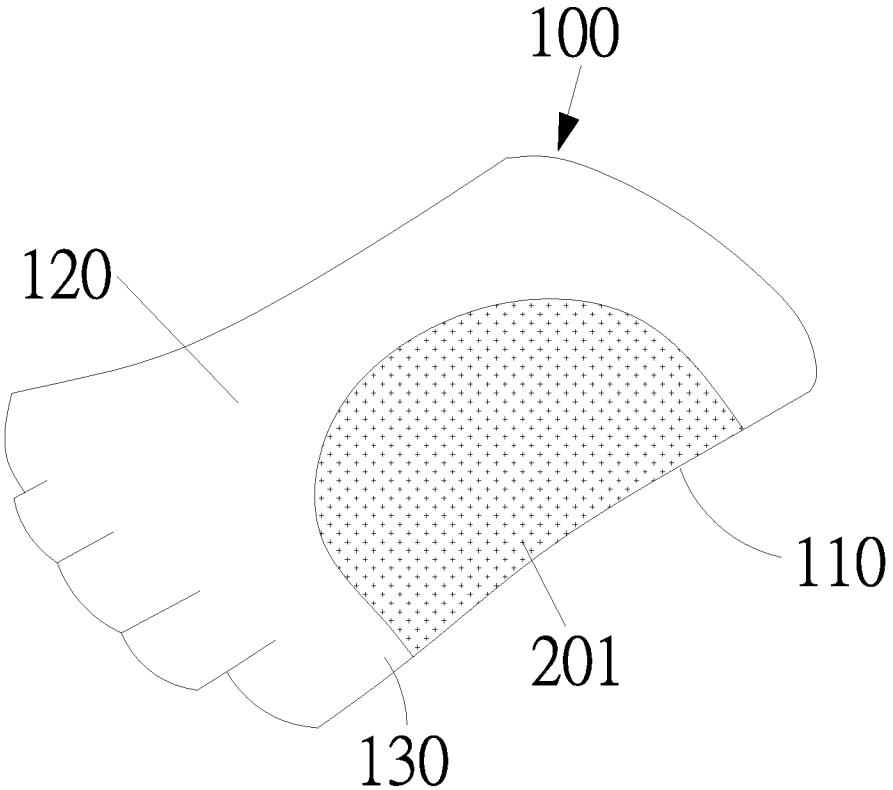
FIG. 3 shows a structural schematic view of a third embodiment of the glove, according to the present invention.

Referring to FIG. 2 for a second embodiment of the present invention, the half palm portion 201 in the glove component covers at least a part of the palm portion 110 and at least a part of the side portion 130 of hand of the glove core 100. Or, as shown in FIG. 3 for a third embodiment of the present invention, the half palm portion 201 in the glove component covers at least a part of the dorsum portion 120 and at least a part of the side portion 130 of hand of the glove core 100.

Figure 4A:
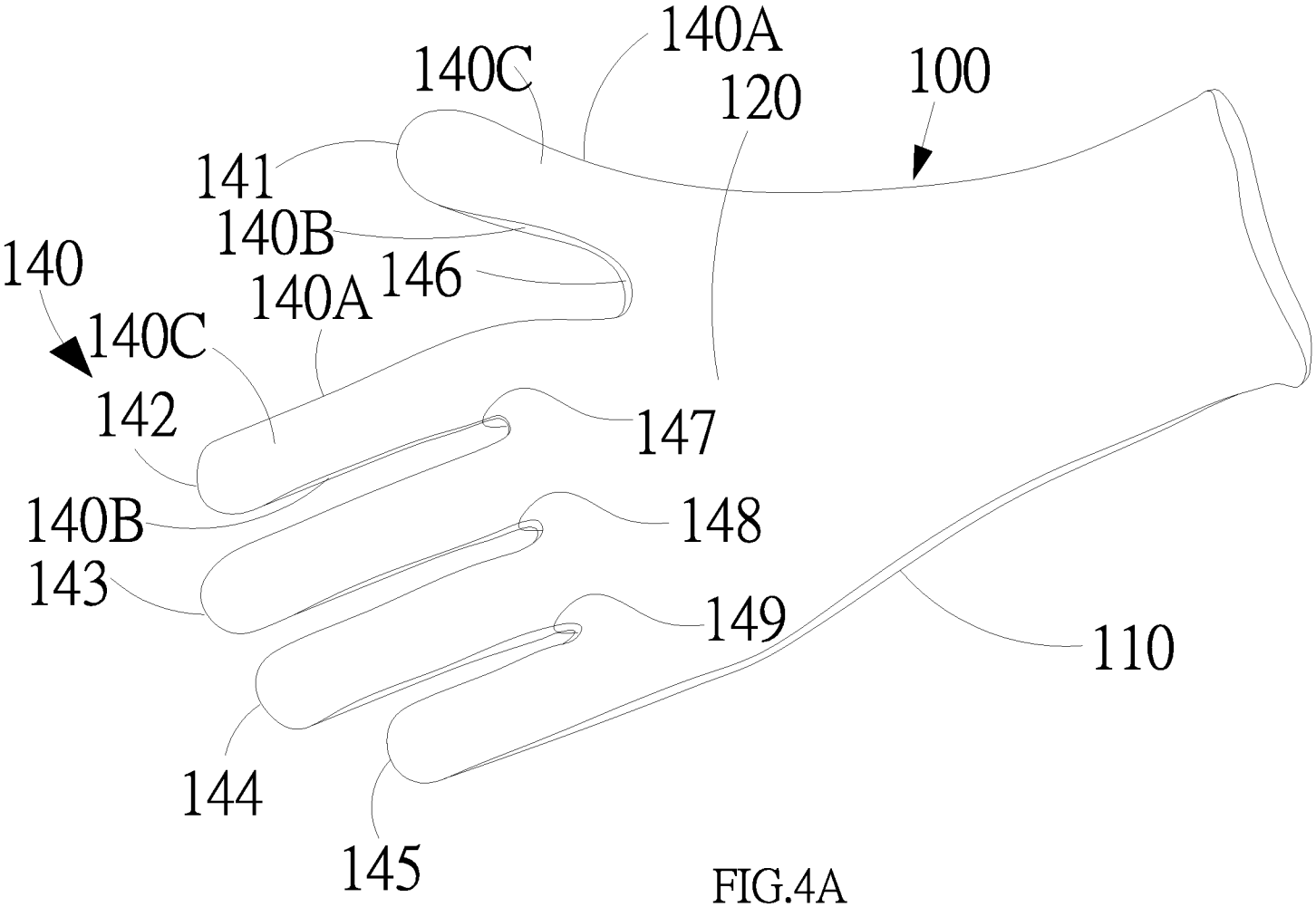
FIG. 4A shows a first structural schematic view of a fourth embodiment of the glove, according to the present invention.

It is naturally that in the abovementioned embodiments, the glove core 100 can be also provided with at least a palm portion 110, a dorsum portion 120 and a finger portion 140, as shown in FIG. 4A for a fourth embodiment of the present invention. The finger portion 140 further includes a thumb sleeve 141, an index finger sleeve 142, a middle finger sleeve 143, a ring finger sleeve 144, a little finger sleeve 145, a web space 146 disposed between the thumb sleeve 141 and the index finger sleeve 142, and three fork portions (which are an index finger fork portion 147, a middle finger fork portion 148 and a little finger fork portion 149, respectively) disposed among the index finger sleeve 142, the middle finger sleeve 143, the ring finger sleeve 144 and the little finger sleeve 145. The finger portion 140 further includes a finger face portion 140A, a fourchette portion 140B and a finger dorsum portion 140C disposed respectively on the thumb sleeve 141, the index finger sleeve 142, the middle finger sleeve 143, the ring finger sleeve 144 and the little finger sleeve 145.

Figure 4B:
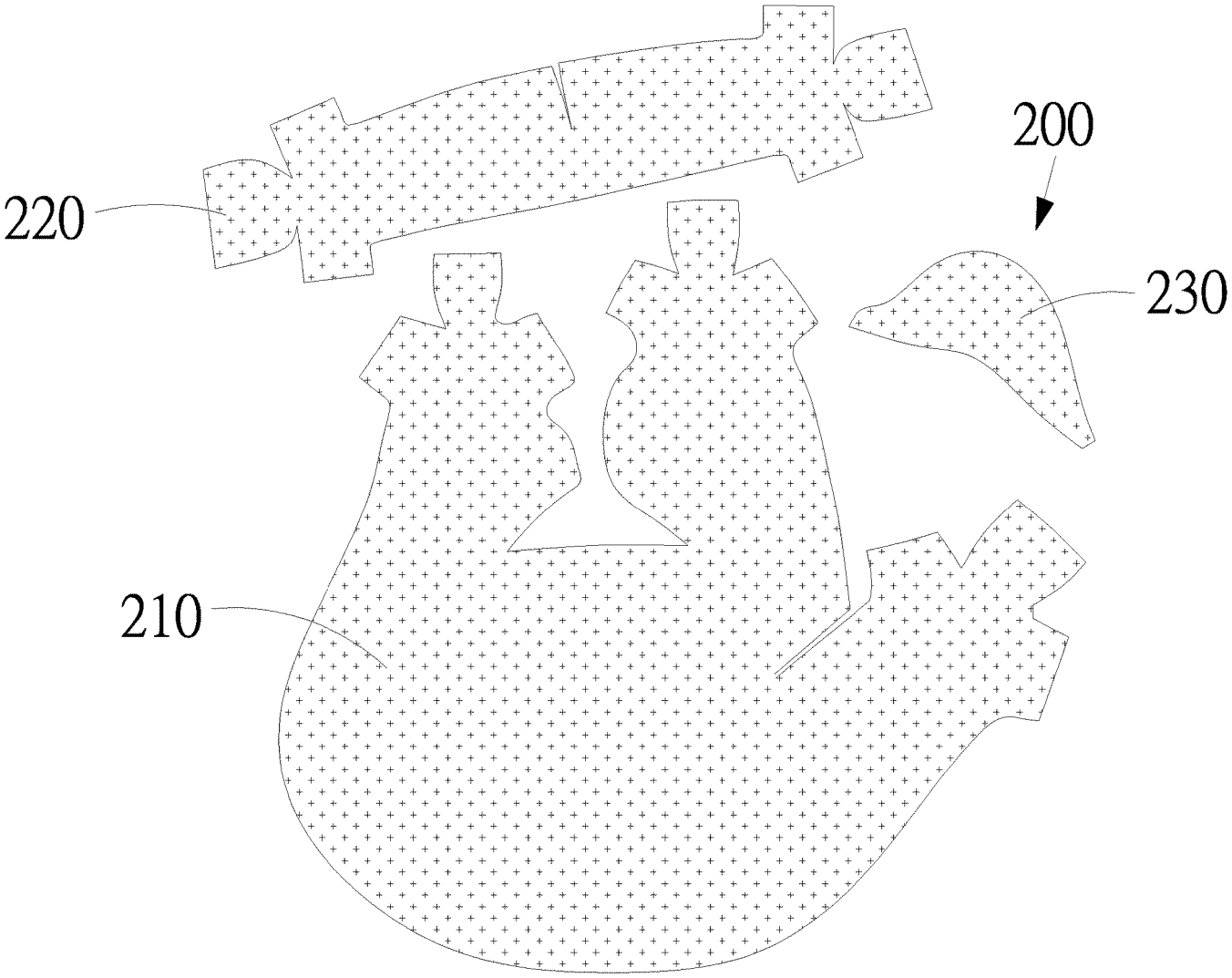
FIG. 4B shows a second structural schematic view of the fourth embodiment of the glove, according to the present invention.
Figure 4C:
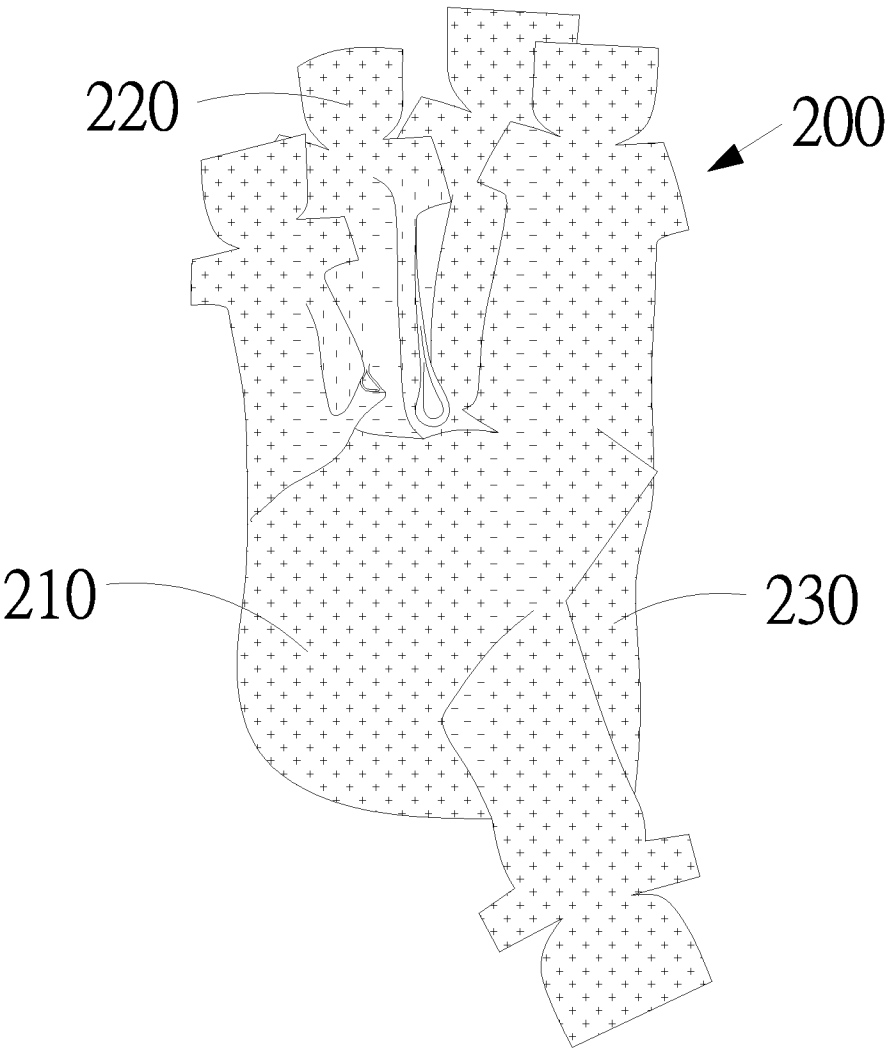
FIG. 4C shows a third structural schematic view of the fourth embodiment of the glove, according to the present invention.
Figure 4D:
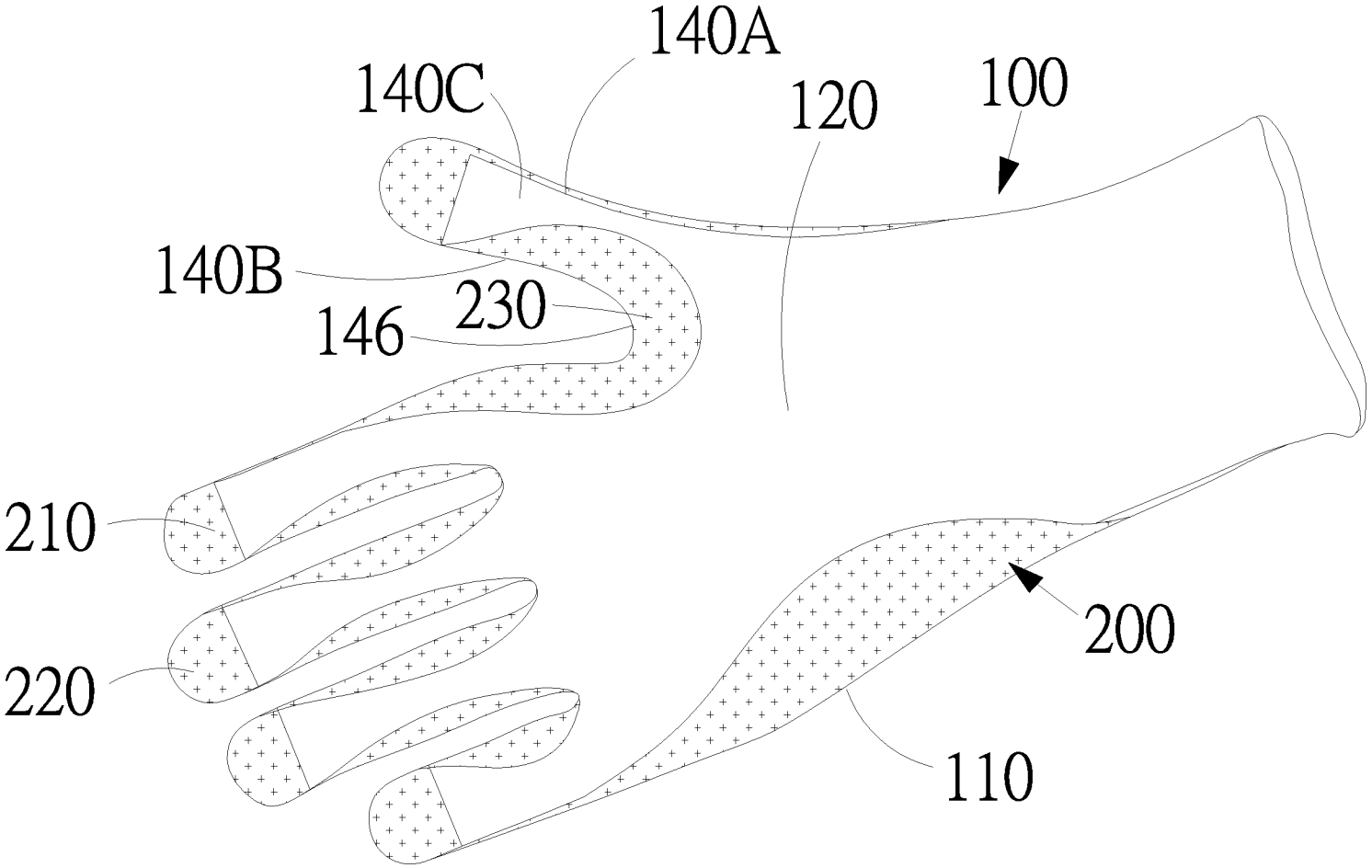
FIG. 4D shows a fourth structural schematic view of the fourth embodiment of the glove, according to the present invention.

Referring to FIG. 4B, the glove component 200 is formed by adhering together a half palm portion 210, a butterfly portion 220 and a web space support portion 230. The half palm portion 210 includes a palm support piece, as well as a thumb piece, an index finger piece and a little finger piece which are disposed at a side of the palm support piece and are independent from one another. The butterfly portion 220 includes a middle finger and ring finger. By adhering a section from the index finger piece to the little finger piece of the half palm portion 210 with the middle finger and the ring finger of the butterfly portion 220, and then adhering the web space support portion 230 between the thumb piece and the index finger piece, the glove component 200 can be formed, as shown in FIG. 4C. Furthermore, the glove component 200 is adhered on a surface of the glove core 100, and then the glove component 200 will cover at least a part of the palm portion 110 and at least a part of the finger portion 140 of the glove core 100, as shown in FIG. 4D. An edge of the glove component 200 is provided with an adhesive layer (not shown in the drawing), and at least a part of the half palm portion 210 covers at least a part of the palm portion 110 of the glove core 100; whereas, the rest parts of the half palm portion 210 and the butterfly portion 220 cover all the finger face portions 140A of the finger portion, and cover back to parts of the finger dorsum portions 140C from the fourchette portions 140B. In addition, the web space support portion 230 covers the web space 146 of the glove core 100. These form a three-dimensional configuration to comply with the ergonomic principle.

Figure 5:
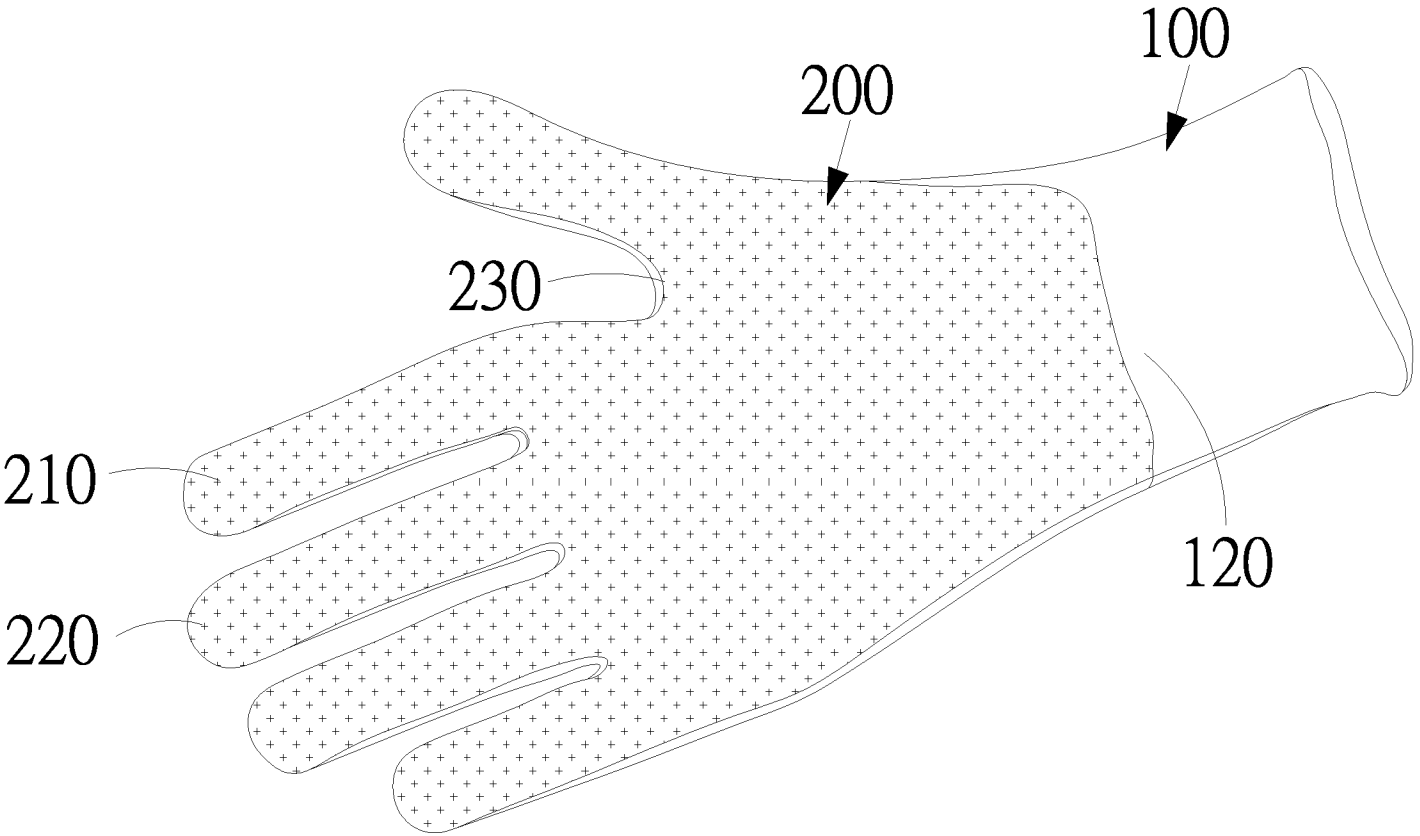
FIG. 5 shows a structural schematic view of a fifth embodiment of the glove, according to the present invention.

Referring to FIG. 5 for a fifth embodiment of the present invention, the glove component 200 is formed by adhering together a half palm portion 210, a butterfly portion 220 and a web space support portion 230. The half palm portion 210 includes a dorsum piece, as well as a thumb piece, an index finger piece and a little finger piece which are disposed at a side of the dorsum piece and are independent from one another. The glove component 200 covers at least a part of the dorsum portion 120 and at least a part of the finger portion of the glove core 100. It is naturally that the glove component 200 can cover all the finger dorsum portions of the finger portions 140 and cover back to parts of the finger face portions from the fourchette portions. Or, the glove component 200 covers at least a part of the palm portion, at least a part of the dorsum portion and at least a part of the finger portion.

Figure 6A:
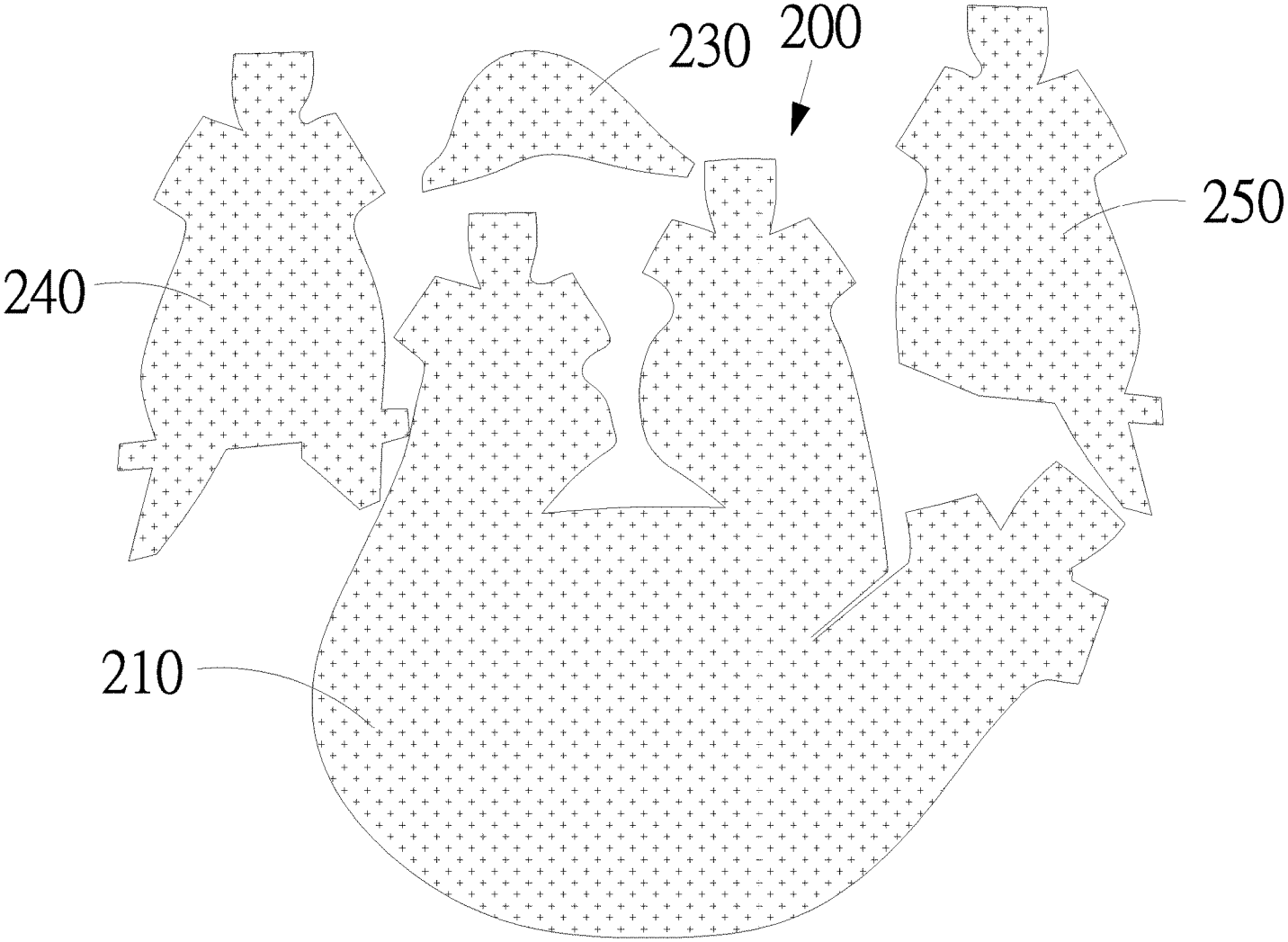
FIG. 6A shows a structural schematic view of another embodiment of a glove component, according to the present invention.
Figure 6B:
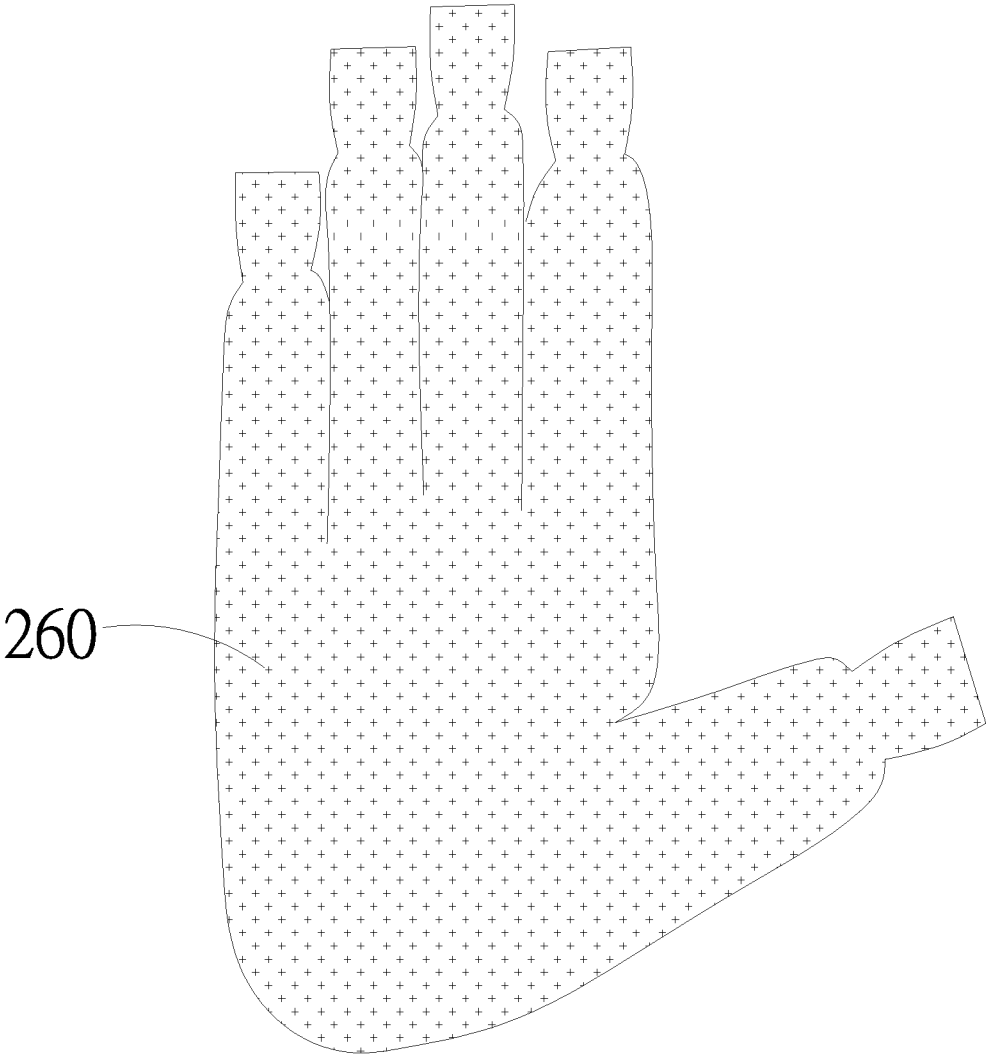
FIG. 6B shows a structural schematic view of still another embodiment of the glove component, according to the present invention.

The abovementioned glove component 200 can be also formed by adhering together a half palm portion 210, a middle finger portion 240, a ring finger portion 250 and a web space support portion 230, as shown in FIG. 6A. Or, as shown in FIG. 6B, the glove component is provided with a large palm portion 260 which includes a palm portion and a finger portion disposed at a side of the palm portion.

Figure 7:
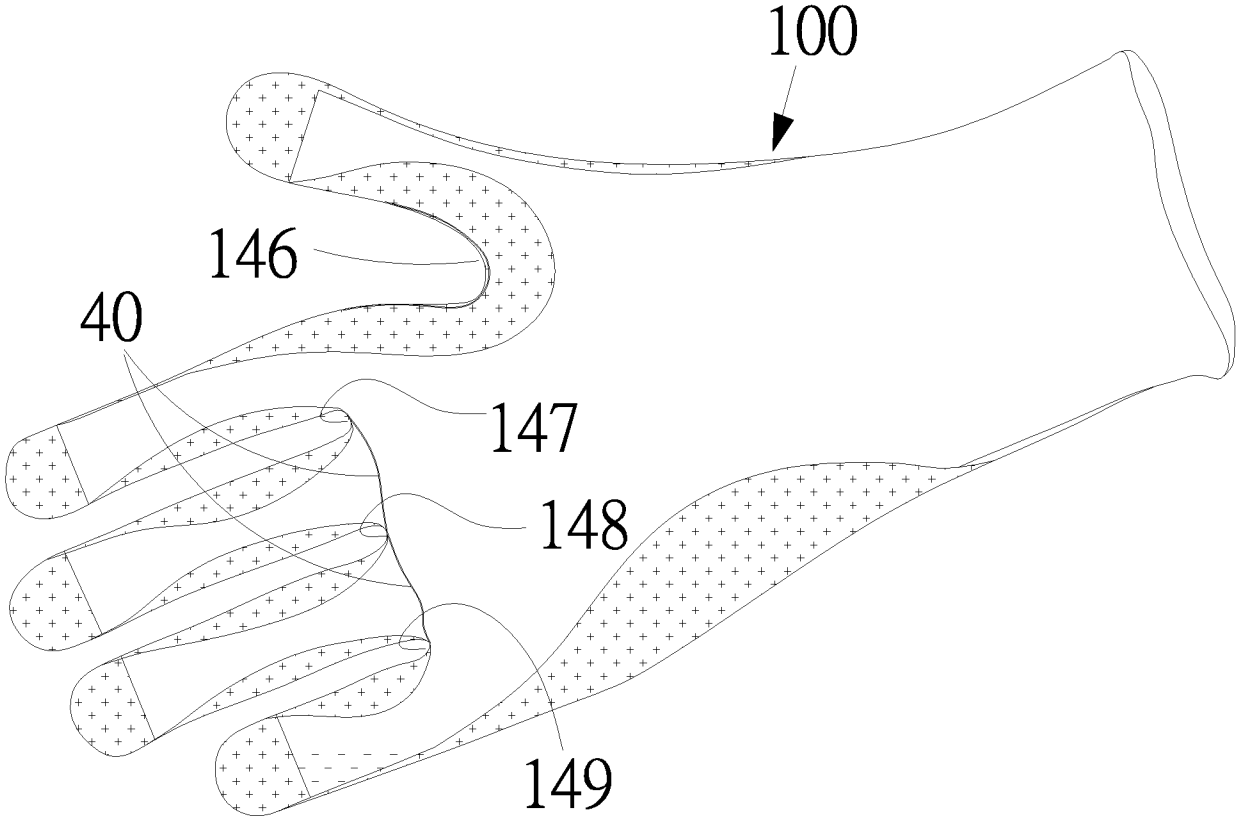
FIG. 7 shows a structural schematic view of a sixth embodiment of the glove, according to the present invention.

Moreover, the glove component covers the web space 146, and at least a part of the fork portions 147, 148, 149 is sewn on a surface of the glove core 100, as shown in FIG. 7 for a sixth embodiment of the present invention. In other words, the web space 146 and the part of the fork portions 147, 148, 149 are not provided with the adhesive layer to fix the glove component at the glove core 100, but are provided with a sewing thread 40 to fix the two, thereby increasing the comfortableness in using the glove.

Figure 8:
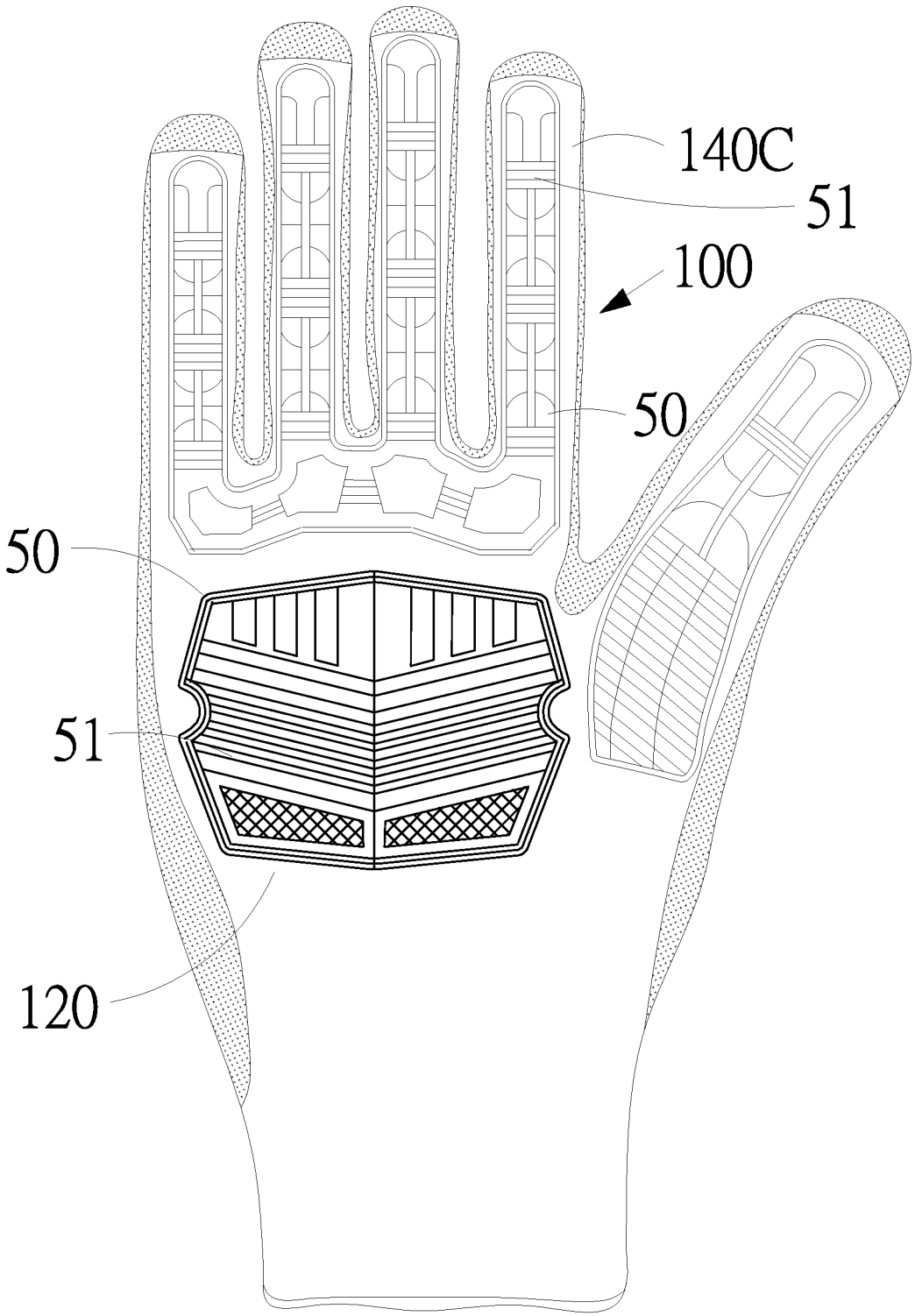
FIG. 8 shows a structural schematic view of a seventh embodiment of the glove, according to the present invention.

In addition, as shown in FIG. 8 for a seventh embodiment of the present invention, at least a protection layer 50 is combined on a surface of the glove core 100 not being covered by the glove component. The protection layer 50 can be a PVC layer, and as the embodiment shown in the drawing, the dorsum portion 120 of the glove core 100 and the finger dorsum portion 140C of the finger portion are provided with the protection layer 50. In addition, a surface of the protection layer 50 can be further provided with at least an anti-slip strip 51. As the PVC layer is provided with a good property of hardness (with a higher Shore hardness value), the shock-proof ability and the safety function in using the glove can be improved.

Figure 9:
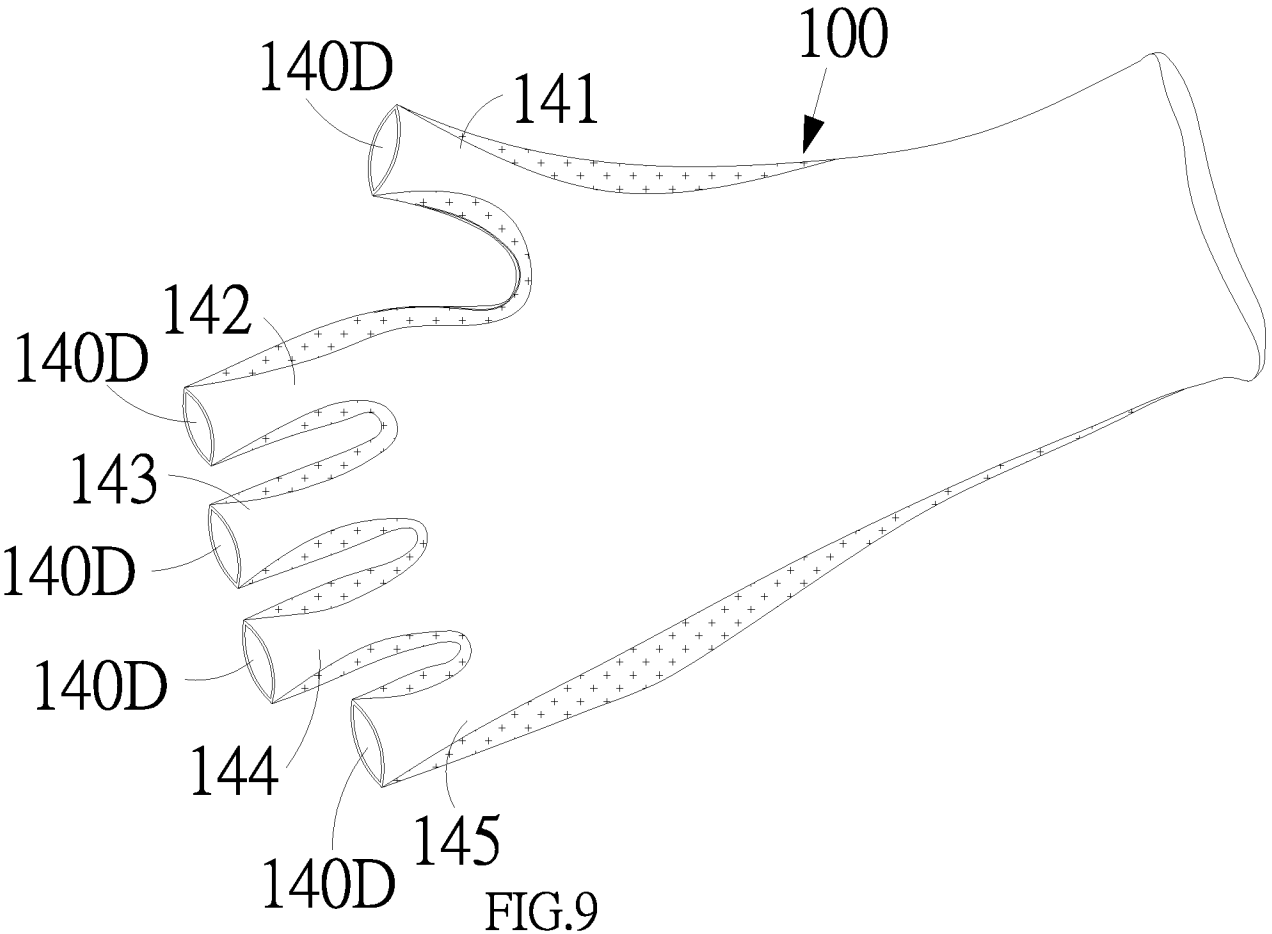
FIG. 9 shows a structural schematic view of an eighth embodiment of the glove, according to the present invention.

In the abovementioned embodiments, the glove can be also a structure in a shape of half fingers, as shown in FIG. 9 for an eighth embodiment of the present invention, wherein each tail end of the thumb sleeve 141, the index finger sleeve 142, the middle finger sleeve 143, the ring finger sleeve 144 and the little finger sleeve 145 is provided respectively with an opening 140D from which fingers can pass through when a user is wearing the glove.

Furthermore, another side of the glove component is combined with at least a protection layer. For example, a protection layer is disposed outside the web space. The said protection layer can be made of sponge, nitrile rubber, PVC or EVA (Ethylene Vinyl Acetate copolymer), and it should be mentioned that a hard material is preferably chosen for the protection layer to enhance the protection to the web space of the glove.

On the other hand, the protection layer can be also disposed outside the finger portion. The protection layer can be a TPU (Thermoplastic Polyurethane) carbon fiber layer. The TPU carbon fiber layer is similarly provided with good hardness, further improving the shock-proof ability and the abrasion-resistance function of the glove, as well as providing better safety protection in special operation, through protecting the fingers in the glove. The protection layer at the finger portion can be further sheathed with magnetic sleeves in five different sizes. For example, the magnetic sleeves are elastic elements and have good magnetism. As the surfaces on the finger protection layer corresponding to five fingers of the glove core are all sheathed with the magnetic sleeves, allowing the magnet to adsorb some tiny iron products (such as wire nails), the user can pick up the wire nails easily. In addition, the magnetic sleeves can further enhance the protection of the glove to the fingers, preventing the user from getting hurt. Therefore, the functions of preventing the user's hand from being tamped and cracked, pressed by heavy objects or pricked (e.g., by glass, needles or wire nails) can be provided. Furthermore, the abrasion-resistance can be improved. The magnetic sleeves are sheathed with the glove core and can be dismantled and taken down at any time when they are not to be used.

In addition, a protection layer can be also disposed outside the palm face of the glove component opposite to the glove core. The protection layer can be made of sponge, foam, cotton, nitrile rubber, PVC or EVA. Two protection layers can be also disposed outside the palm face of the glove component opposite to the glove core, wherein the inner protection layer can be made of sponge, foam, cotton, nitrile rubber, PVC or EVA, and the outer protection layer can be made of fiber (super fiber), cloth, leather or an elastic material.

Besides that, the glove component is provided with at least a decoration portion. For example, a decoration line is disposed on at least an edge of the glove component as the decoration portion. This decoration line allows the user to feel that the glove has been sewn, and to a certain extent, enhances the robustness of the glove component and the glove core after being adhered together.

All kinds of manufacturing method for making the glove of the present invention are disclosed hereinafter.

A first manufacturing method includes following steps:

(a) A glove core is provided. The glove core can be a fingerless glove core, a half finger glove core or a full finger glove core as in the abovementioned embodiments. The glove core can be a knitted glove core or a sewn glove core. The following description is based upon a full finger glove core.

(b) At least a glove component is provided. The glove component is provided with a half palm portion, or a half palm portion, a butterfly portion and a web space support portion, or a half palm portion, a middle finger portion, a ring finger portion and a web space support portion, or a large palm portion, as described in the abovementioned embodiments. The following description is based upon a glove component including a half palm portion 210, a middle finger portion 240, a ring finger portion 250 and a web space support portion 230, as shown in FIG. 6A.

Figure 10:
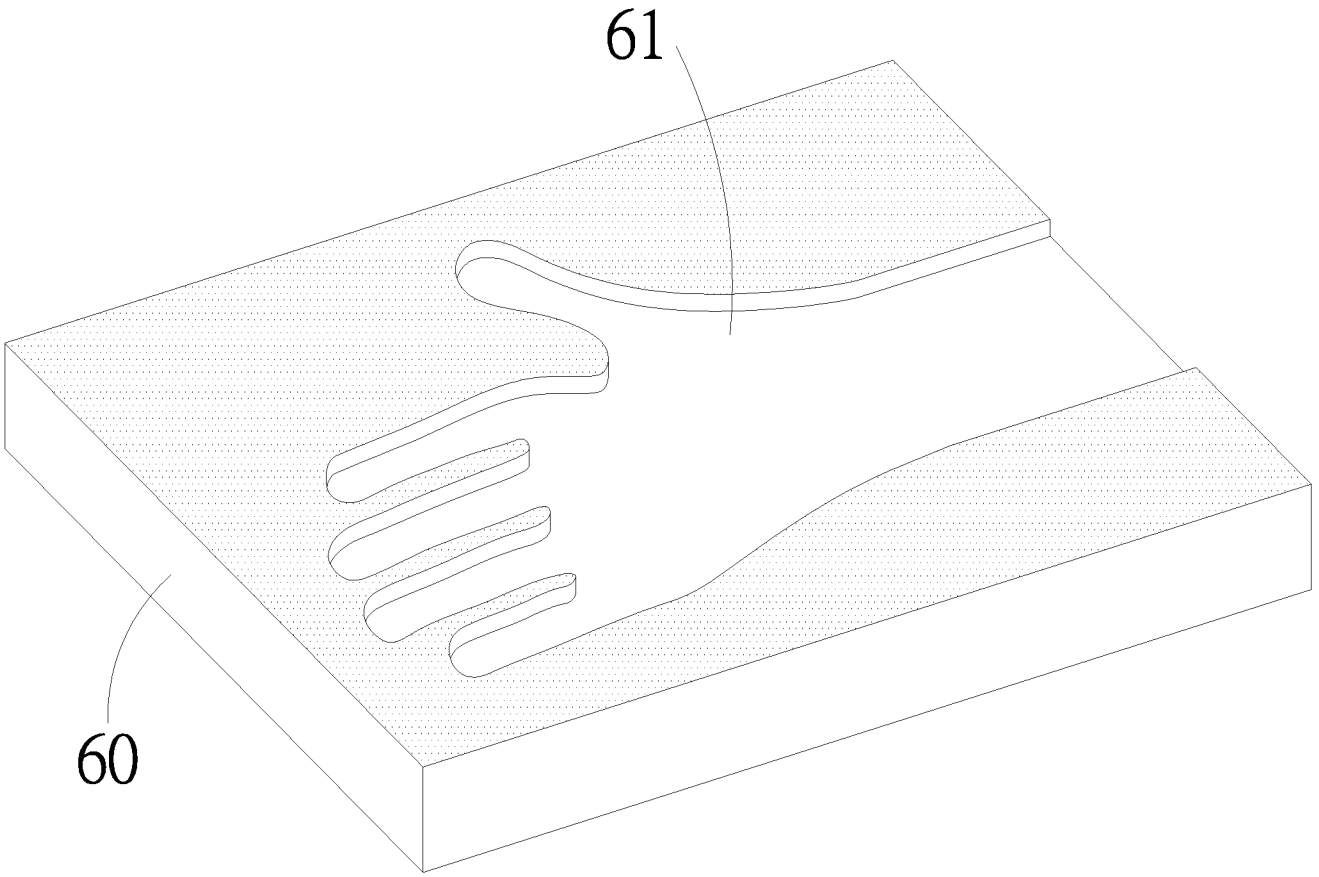
FIG. 10 shows a three-dimensional structural view of a mold base, according to the present invention.

(c) A mold base 60 is provided, as shown in FIG. 10. A side of the mold base 60 is provided with a holding portion 61 to accommodate the glove component. As shown in the drawing for the embodiment, the holding portion 61 is provided with a profile corresponding to the glove core, and can be concaved into or protruded out of the mold base 60.

Figure 11:
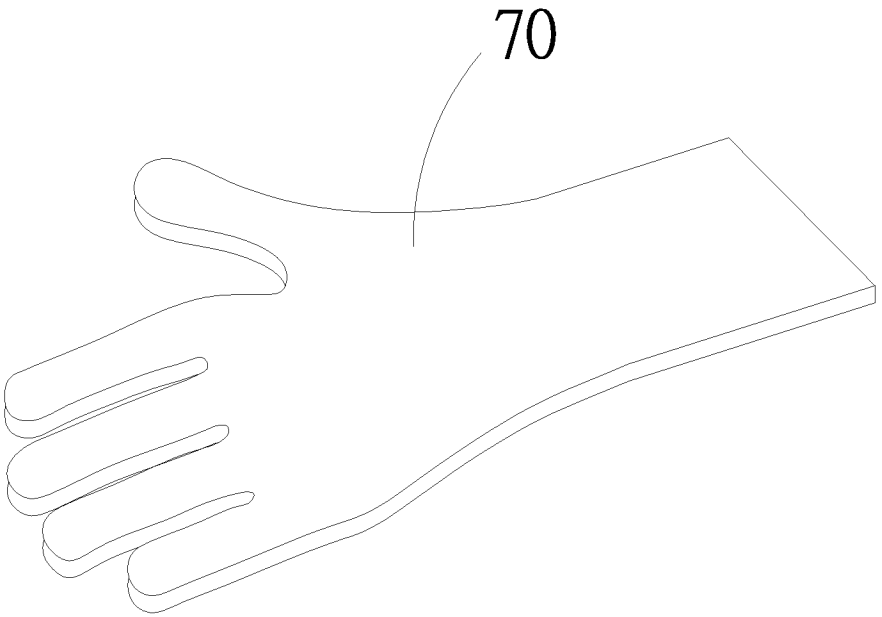
FIG. 11 shows a three-dimensional structural view of a hand-type mold, according to the present invention.

(d) A hand-type mold 70 is provided, as shown in FIG. 11. The hand-type model 70 is provided with a profile corresponding to the glove core, combining together the half palm portion, a middle finger portion, a ring finger portion and a web space support portion. First, a viscous interface material is disposed on a location where the middle finger portion is to be combined with the ring finger portion (such as by patching with an adhesive film or coating with glue), followed by being disposed on a location corresponding to the holding portion of the mold base. Next, the hand-type mold 70 is disposed on the holding portion of the mold base and is abutted at the middle finger portion and the ring finger portion. The middle finger portion and the ring finger portion are then combined together by a pressing method. It is naturally that the glove core can be first sheathed outside the hand-type mold 70 and is then disposed on the mold base.

Next, a viscous interface material is disposed on a location where the half palm portion is to be combined with the web space support portion (such as by patching with an adhesive film, spraying or coating with glue), followed by being disposed on a location corresponding to the holding portion of the mold base and by disposing the combined middle finger portion and ring finger portion on the location corresponding to the holding portion of the mold base. The hand-type mold 70 is then disposed on the holding portion of the mold base and is abutted at all of the abovementioned parts which are then combined together by a pressing method, forming a semi-finished product of the glove component. It is naturally that the parts can be also adhered and fixed together by a high-frequency wave or a pressing method.

Figure 12:
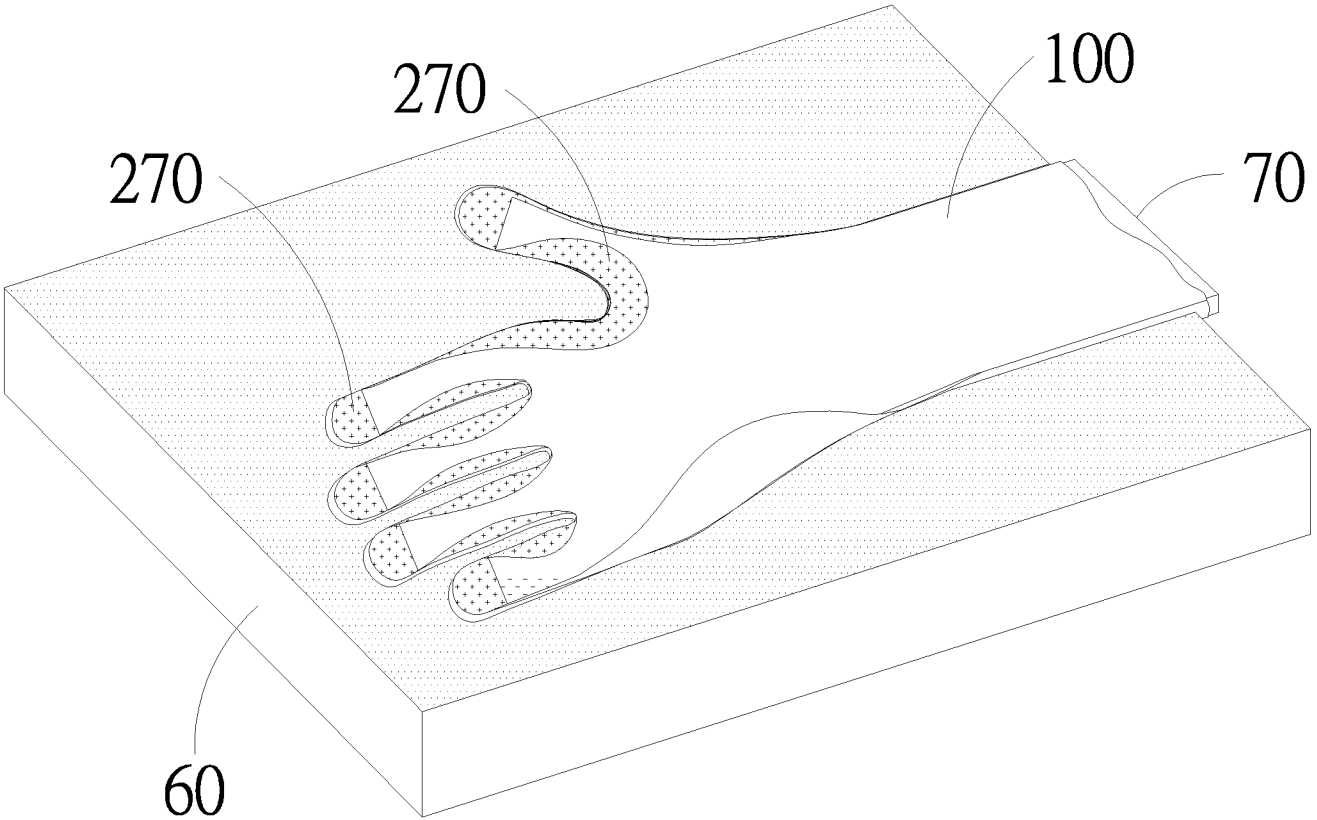
FIG. 12 shows a three-dimensional structural view of the hand-type mold overlapped on the mold base, according to the present invention.

(e) The glove component is combined with the glove core. The abovementioned semi-finished product of the glove component (i.e., the glove component after being adhered) is disposed at the holding portion of the mold base, the glove core is sheathed outside the hand-type mold 70, and then the hand-type mold 70 that is sheathed with the glove core is overlapped onto the holding portion. After disposing the abovementioned semi-finished product of the glove component at the holding portion of the mold base, edges of the semi-finished product of the glove component are put upright from the holding portion, so as to cover back the upright section of the semi-finished product of the glove component to the surface of the glove core, forming cover back portions 270, as shown in FIG. 12. Finally, a side of the glove component is adhered, for example, from the cover back portions 270, on the surface of the glove core by a pressing method, followed by performing demolding to accomplish the glove of the present invention.

The second manufacturing method is about the same as the first manufacturing method, with the difference in that the second manufacturing method further provides an automatic transmission device to transmit the plural pre-formed glove cores and glove components. In addition, the automatic transmission device is provided with a first work station to dispose the viscous interface material. For example, by patching with an adhesive film, coating with glue or spraying with glue using a spraying machine, an adhesive layer in a thickness of 0.3~0.9 mm and a width of 2~10 mm can be formed. A second work station is disposed after the first work station to heat up the plural glove cores and the plural glove components that are provided with the viscous interface material. The heat-up can be performed using an oven under a heating temperature of 5~250° C., preferably 30~120° C.

Moreover, a third work station is disposed after the second work station to adhere together the plural glove components in step (d) above. A simple pressing is only needed to adhere the glove components in about 3~20 sec with a pressing machine, preferably 3~15 sec. Finally, step (e) above is performed to combine the glove component with the glove core, and demolding is carried out to accomplish the glove of the present invention.

Figure 13A:
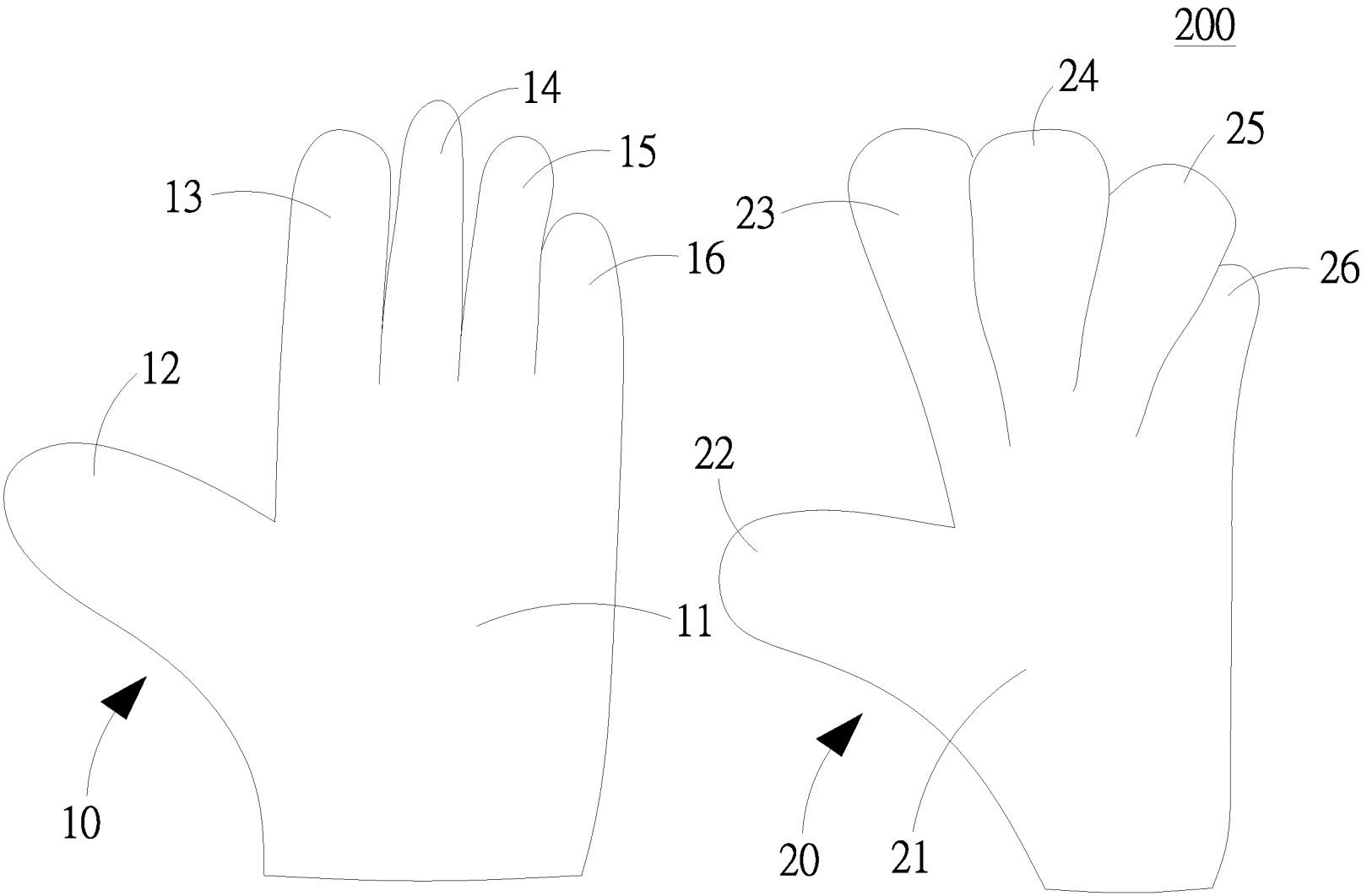
FIG. 13A shows a structural schematic view of a first embodiment of a glove component, according to the present invention.
Figure 13B:
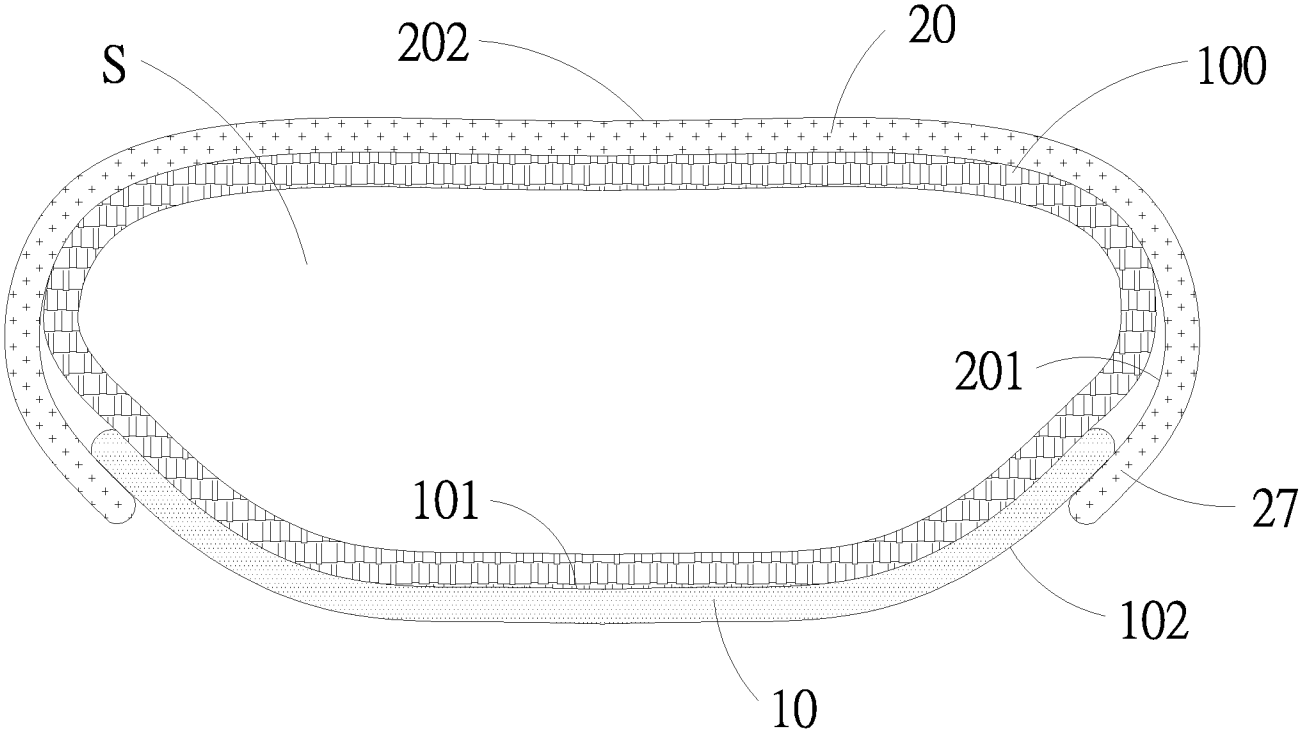
FIG. 13B shows a second structural schematic view of the first embodiment of the glove component, according to the present invention.

In the abovementioned embodiments of the present invention, the glove component includes at least a first glove component and a second glove component. As shown in FIG. 13A for the embodiment, the first glove component is a palm portion 10 and the second glove component is a dorsum portion 20. Referring to FIG. 13B, the palm portion 10 of the first glove component is provided with a first inner surface 101 and a first outer surface 102 opposite to the first inner surface 101; whereas, the dorsum portion 20 of the second glove component is provided with a second inner surface 201 and a second outer surface 202 opposite to the second inner surface 201. The first inner surface 101 and the second inner surface 201 form a holding space S, and at least a part of the second inner surface 201 is adhered on the first outer surface 102 by a combination region 27. The combination region 27 can be disposed on an edge of the dorsum portion 20 of the second glove component. For example, the distance from that edge to an end surface of the dorsum portion 20 of the second glove component is larger than 0 cm and smaller than or equal to 5 cm. In addition, the palm portion 10 of the first glove component is adhered with the dorsum portion 20 of the second glove component by the combination region 27, forming a three-dimensional configuration to comply with the ergonomic principle. The abovementioned combination region 27 can be provided with an adhesive layer (not shown in the drawing) which can be made of a viscous interface material, such as PU or acrylate. The adhesive layer can be used to adhere and fix the dorsum portion 20 with the palm portion 10 by patching with an adhesive film or coating with glue. It is naturally that the dorsum portion 20 can be adhered with the palm portion 10 by a high-frequency wave, hot pressing or cold pressing.

Figure 14:
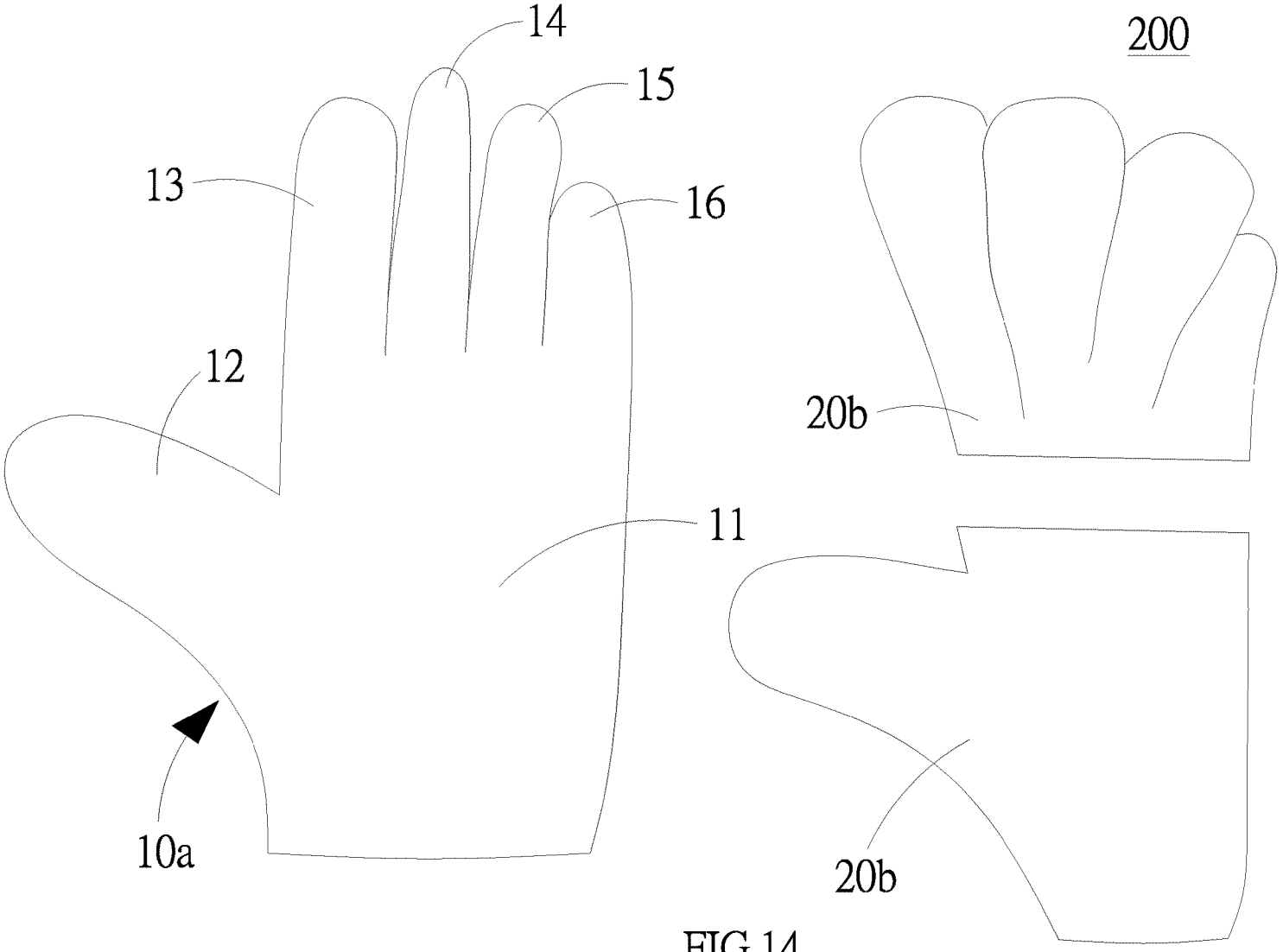
FIG. 14 shows a structural schematic view of a second embodiment of the glove component, according to the present invention.

The abovementioned first glove component is provided with at least a garment section, or the second glove component is provided with at least a garment section. As shown in FIG. 14 for the second embodiment, the palm portion 10 is provided with a hand portion 11, and a first finger portion at a side of the hand portion 11, wherein the first finger portion includes a thumb 12, an index finger 13, a middle finger 14, a ring finger 15 and a little finger 16 which are formed integrally by extending from a side of the hand portion 11. In other words, the first glove component is formed by a single garment section 10*a*, whereas the second glove component includes two garment sections 20*b*.

Figure 15:
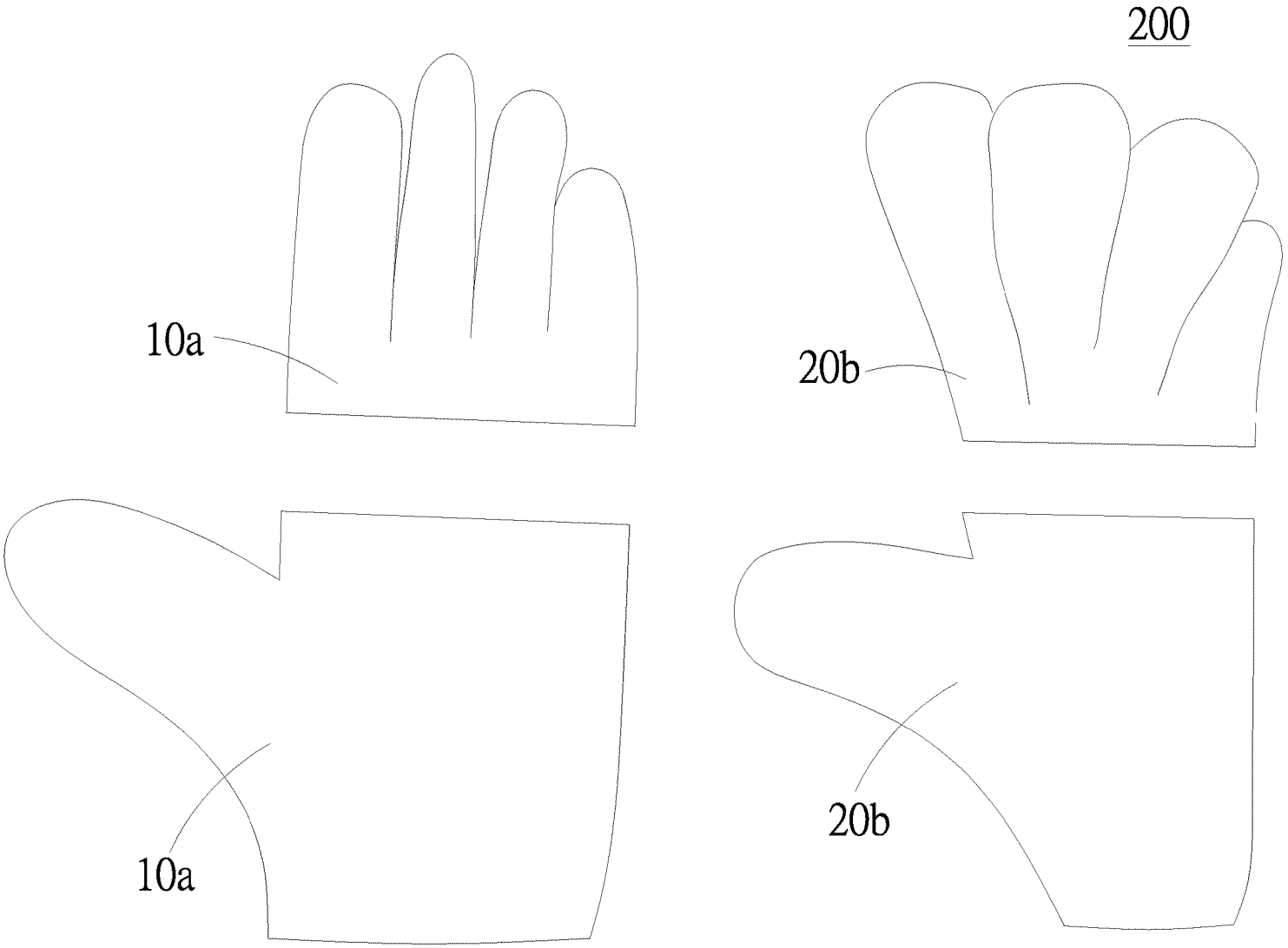
FIG. 15 shows a structural schematic view of a third embodiment of the glove component, according to the present invention.

As shown in FIG. 15 for a third embodiment of the present invention, the first glove component is formed by two garment sections 10*a*, and the second glove component includes two garment sections 20*b*.

Figure 16:
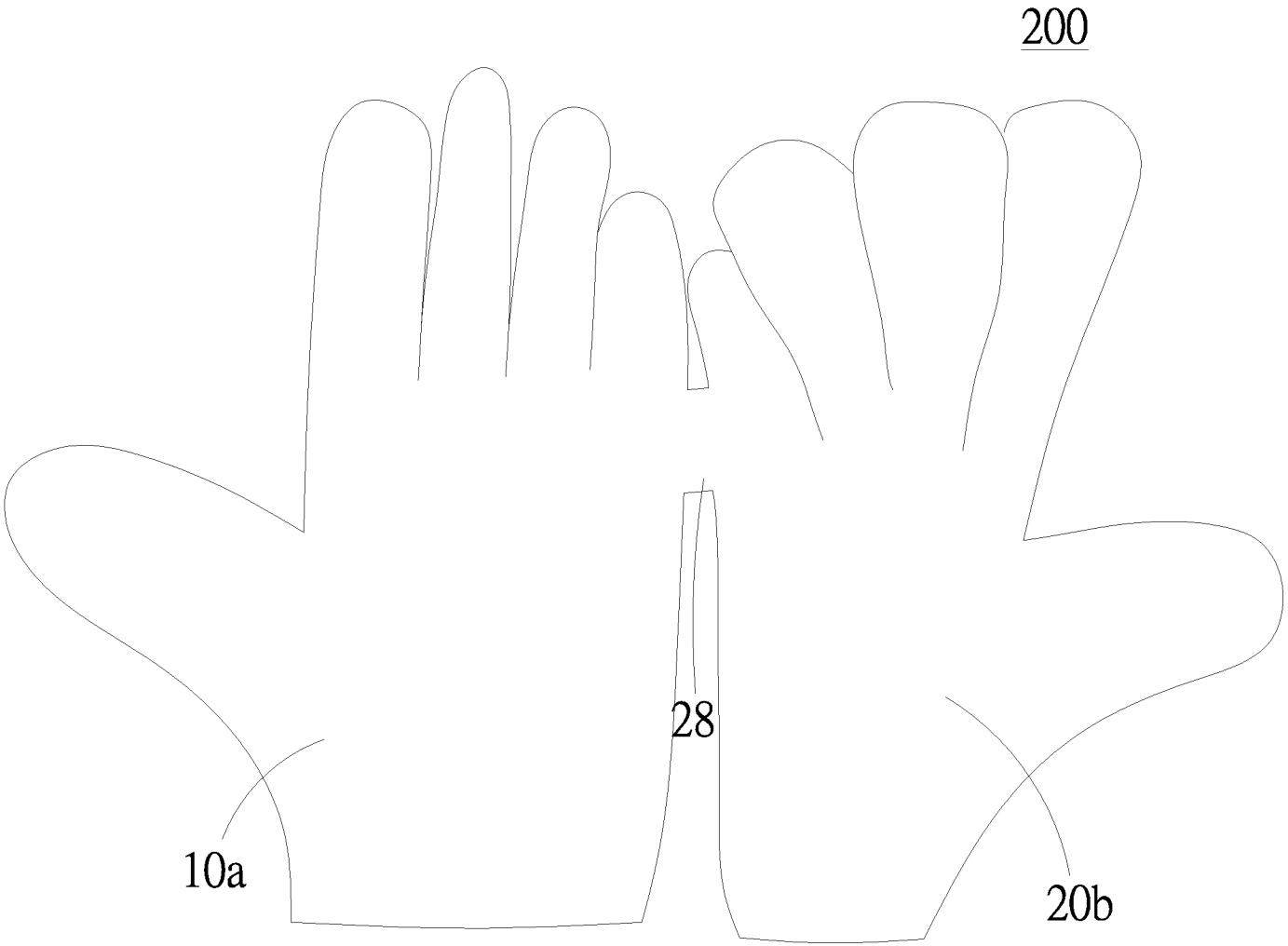
FIG. 16 shows a structural schematic view of a fourth embodiment of the glove component, according to the present invention.

Referring to FIG. 16 for a fourth embodiment of the present invention, the glove component includes a first glove component and a second glove component. As shown in the drawing for the embodiment, the first glove component is a palm portion, the second glove component is a dorsum portion, and the first glove component is connected with the second glove component by a connection portion 28. The first glove component is formed by a single garment section 10*a* and the second glove component is formed by a single garment section 20*b*. The dorsum portion can be adhered and fixed with the palm portion by a combination region, forming the glove component as shown in FIG. 1B.

Figure 17:
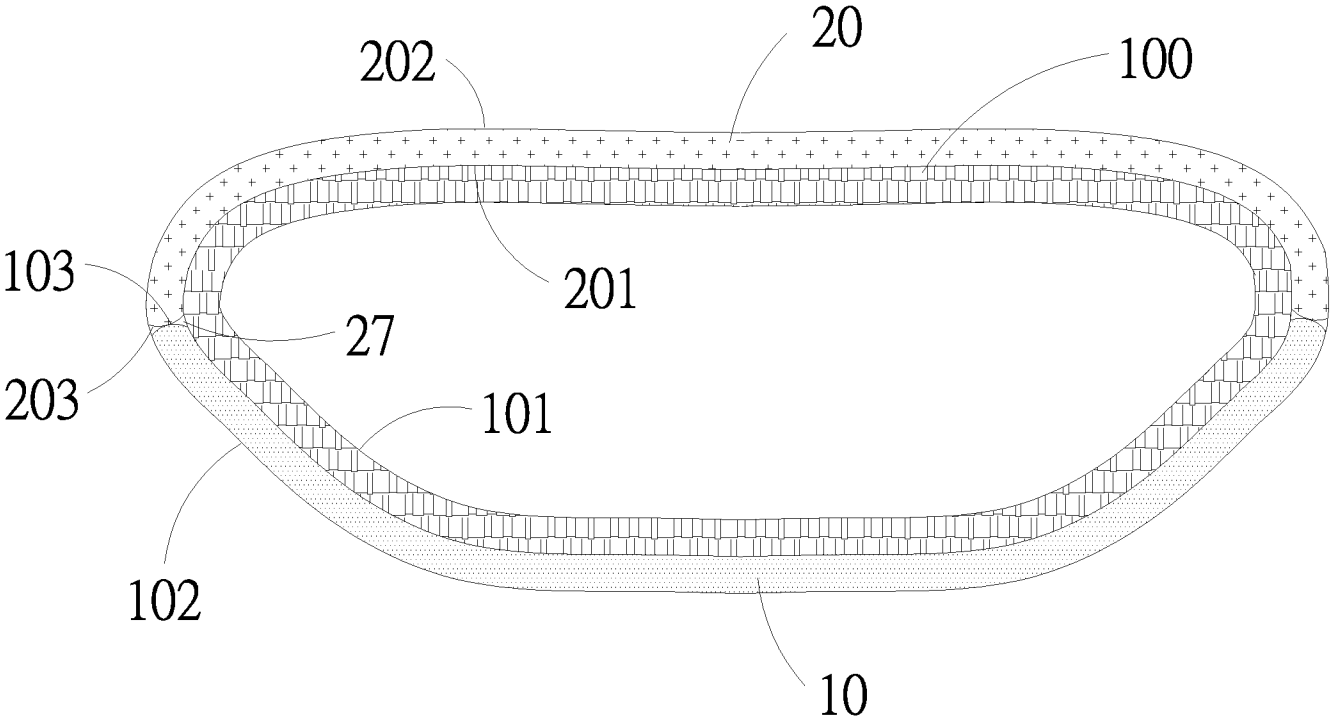
FIG. 17 shows a structural schematic view of a fifth embodiment of the glove component, according to the present invention.

As shown in FIG. 17 for a fifth embodiment of the present invention, the glove component includes a first glove component and a second glove component. The first glove component is a palm portion 10 and the second glove component is a dorsum portion 20. The first glove component is provided with a first inner surface 101, a first outer surface 102 opposite to the first inner surface 101, and a first cross section 103 disposed between the first inner surface 101 and the first outer surface 102. The second glove component is provided with a second inner surface 201, a second outer surface 202 opposite to the second inner surface 201, and a second cross section 203 disposed between the second inner surface 201 and the second outer surface 202. The first cross section 103 is adhered with the second cross section 203 by a combination region 27. The abovementioned combination region 27 can be provided with an adhesive layer (not shown in the drawing) which can be made of a viscous interface material, such as PU or acrylate. By patching with an adhesive film or coating with glue, the adhesive layer can be used to adhere and fix the first glove component with the second glove component. It is naturally that the first glove component can be adhered and fixed with the second glove component by a high-frequency wave, hot pressing or cold pressing.

Figure 18A:
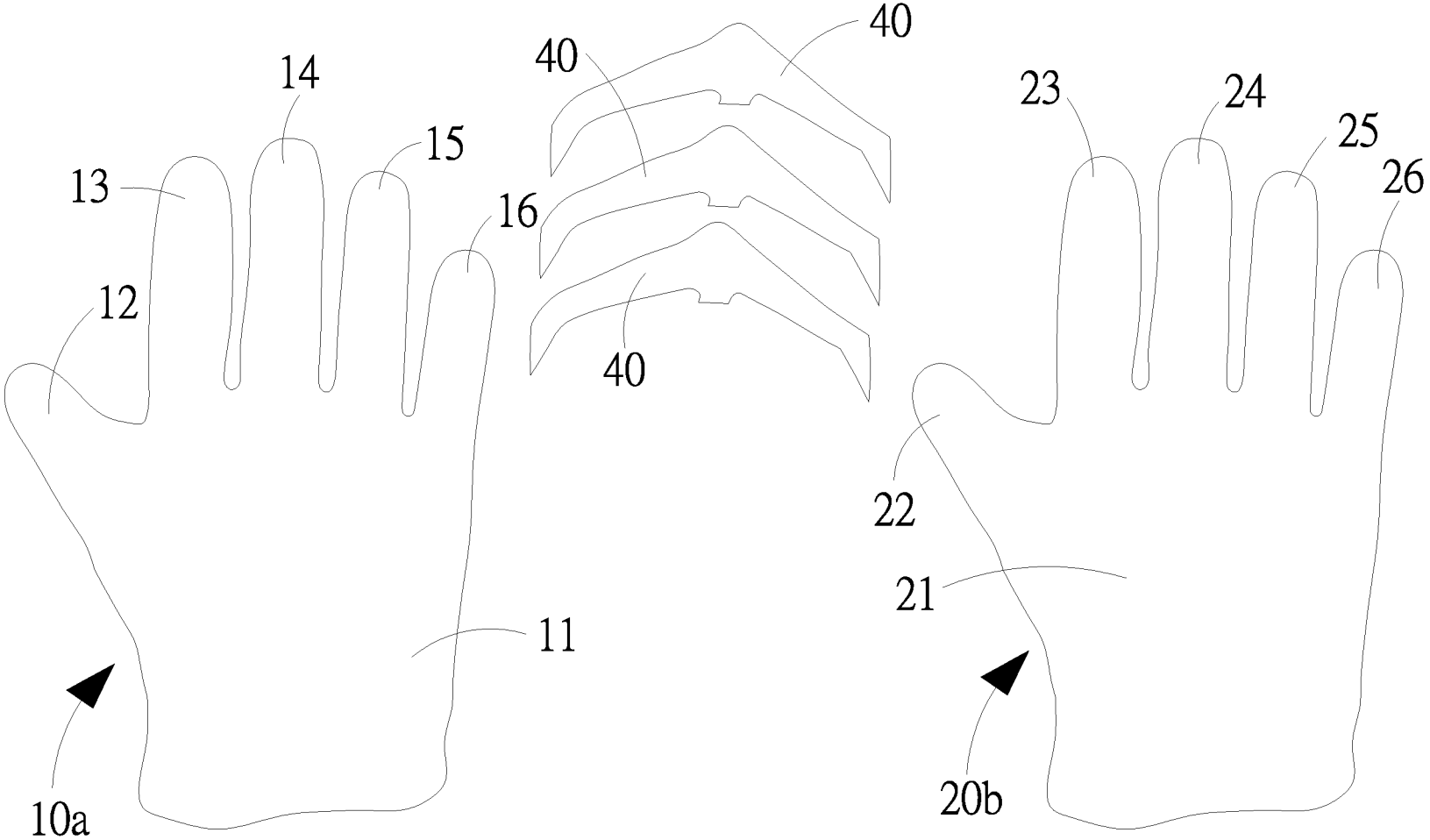
FIG. 18A shows a structural schematic view of a sixth embodiment of the glove component, according to the present invention.
Figure 18B:
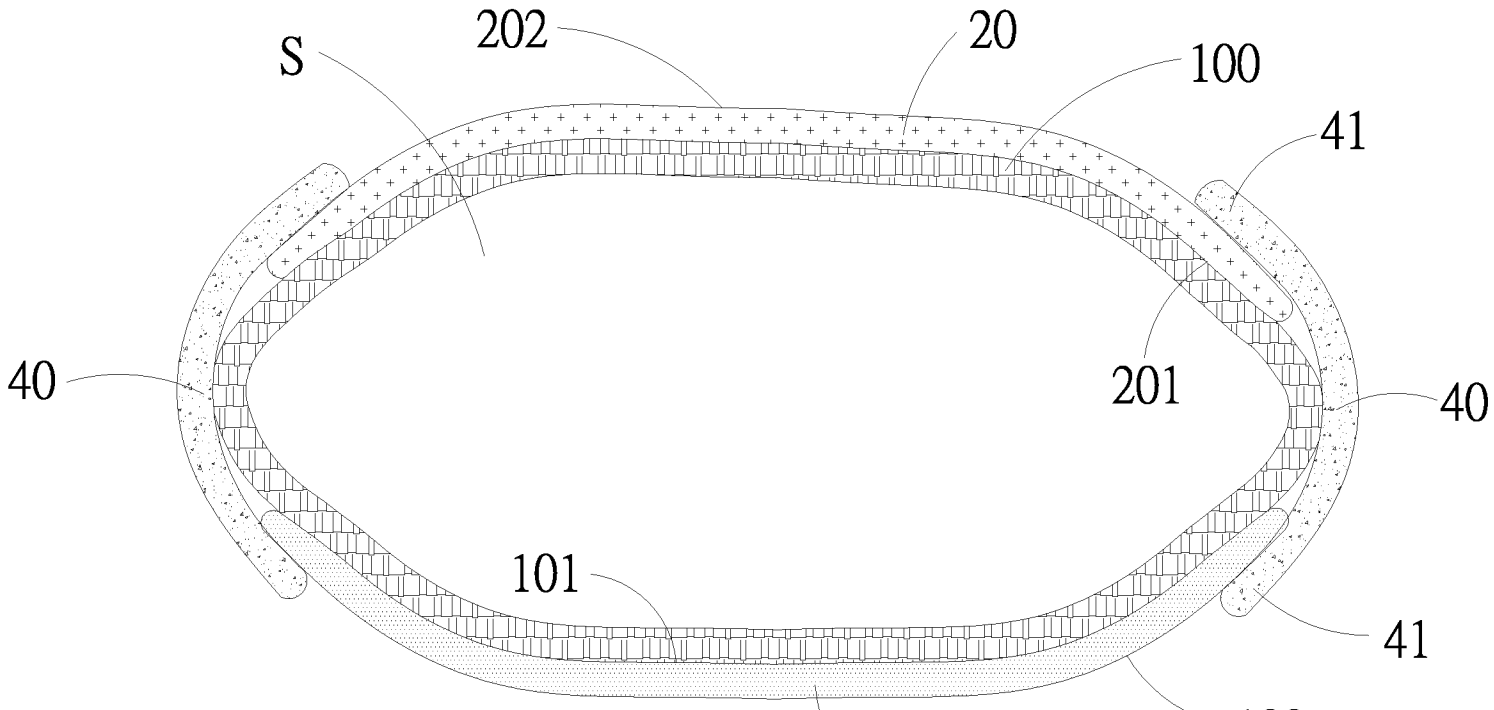
FIG. 18B shows a second structural schematic view of the sixth embodiment of the glove component, according to the present invention.

Referring to FIG. 18A for a sixth embodiment of the present invention, the glove component includes a first glove component, a second glove component and at least a third glove component which is a side strip 40 as an example. As shown in the drawing for the embodiment, the first glove component is a palm portion, the second glove component is a dorsum portion, and three side strips 40 are disposed between the palm portion and the dorsum portion. Referring to FIG. 18B at a same time, the first inner surface 101 of the first glove component and the second inner surface 201 of the second glove component form a holding space S, and two sides of the side strip 40 are adhered with the first glove component and the second glove component by a combination region 41. For example, an edge at one side of the side strip 40 is connected with at least a part of the palm portion 10 by adhering (taking the first outer surface 102 in the drawing as an example); and an edge at the other side of the side strip 40 is connected with at least a part of the dorsum portion 20 by adhering (taking the second outer surface 202 in the drawing as an example). The distance from the edge to an end surface of the side strip 40 is larger than 0 cm and smaller than or equal to 5 cm. It is naturally that the edge at a side of the side strip 40 can be connected with the first inner surface 101 of the palm portion 10 by adhering, and the edge at the other side of the side strip 40 can be connected with the second inner surface 201 of the dorsum portion 20 by adhering.

The thumb 12, the index finger 13, the middle finger 14, the ring finger 15 and the little finger 16 are extended integrally from a side of the hand portion 11. In other words, the first glove component is formed by a single garment section 10*a*. The dorsum portion 20 is provided with a rear portion 21 and a second finger portion disposed at a side of the rear portion 21. The second finger portion includes a rear thumb 22, a rear index finger 23, a rear middle finger 24, a rear ring finger 25 and a rear little finger 26 which are extended integrally from a side of the rear portion 21. In other words, the second glove component is formed by a single garment section 20*b*. It is naturally that in the fifth embodiment, the first glove component can be also provided with at least a garment section 10*a*, or the second glove component can be also provided with at least a garment section 20*b*.

Moreover, in the abovementioned embodiments, the first glove component is a palm portion and the second glove component is a dorsum portion. The design can be also changed into that the first glove component is a dorsum portion and the second glove component is a palm portion, with that the combination region is disposed at the palm portion, still achieving the purpose and effect of the present invention.

Figure 19:
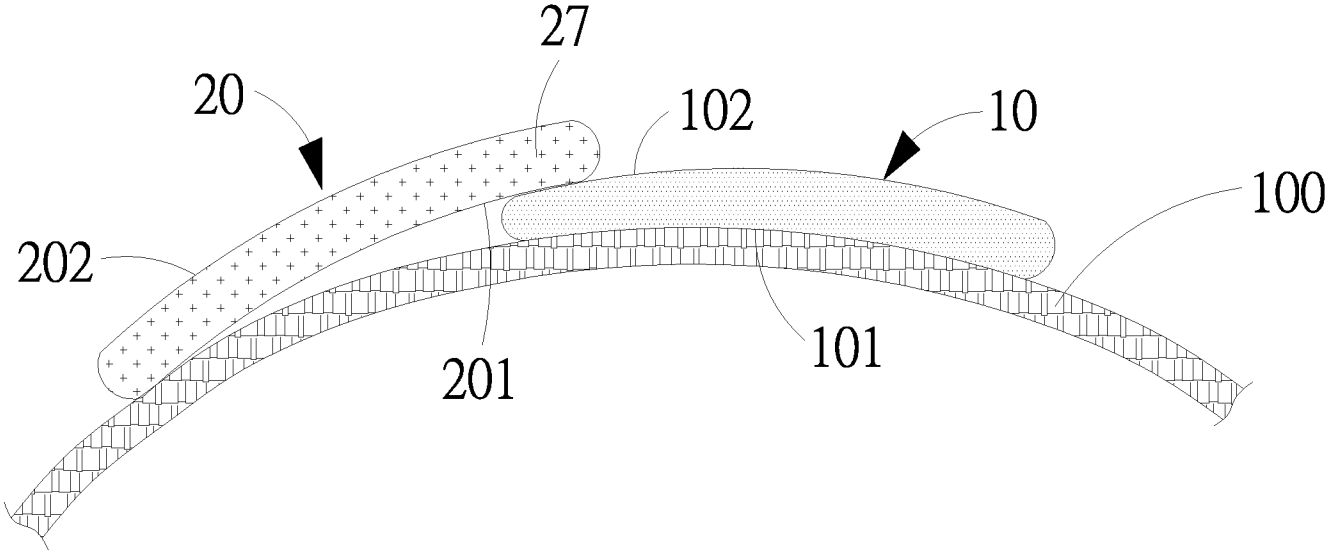
FIG. 19 shows a structural schematic view of a seventh embodiment of the glove component, according to the present invention.
Figure 20:
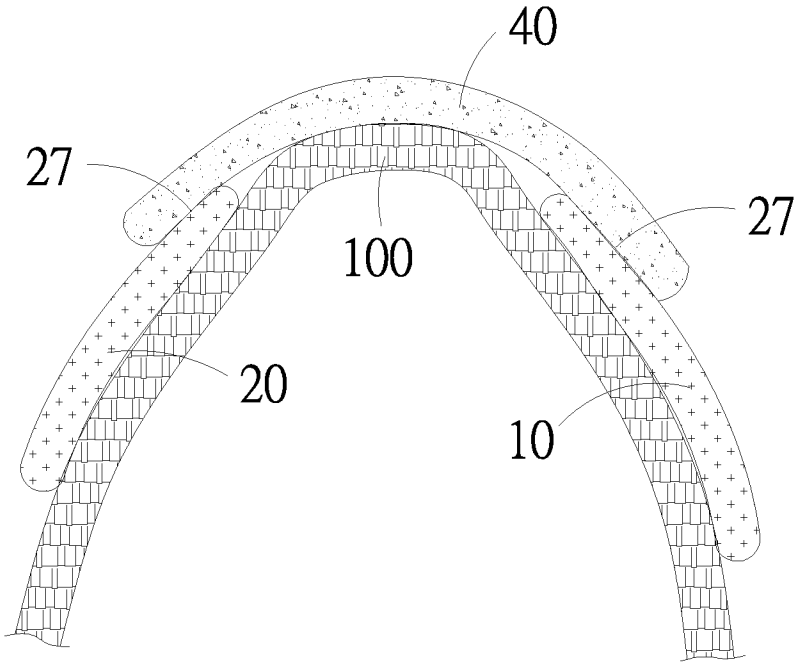
FIG. 20 shows a structural schematic view of an eighth embodiment of the glove component, according to the present invention.

Besides that, in the abovementioned embodiments, the first inner surface of the first glove component and the second inner surface of the second glove component form a holding space to be sheathed in by a user's hand. It is naturally that the present invention can be also used to make a semi-finished product of the glove, as shown in FIG. 19. The first outer surface 102 of the first glove component is adhered with the second inner surface 201 of the second glove component by a combination region 27, but the first inner surface 101 and the second inner surface 201 do not form a holding space. Or, as shown in FIG. 20, the side strip 40 of the third glove component is adhered with the first glove component or the second glove component by a combination region 27.

In the abovementioned embodiments, at least a first glove component and at least a second glove component are combined together to form a glove component, and then the glove component is combined with the glove core to form the glove of the present invention. On the other hand, a side of the glove component is adhered on a surface of the glove core, such that the glove component covers at least a part of the palm portion and at least a part of the dorsum portion of the glove core, at least a part of the palm portion and at least a part of the side portion of hand of the glove core, or at least a part of the dorsum portion of and at least a part of the side portion of hand of the glove core. In addition, the glove component can cover back from a side of the glove core to the other side of the glove core, forming a three-dimensional configuration to comply with the ergonomic principle.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A glove, comprising a glove core and a glove component, with the glove core including a palm portion, a dorsum portion and a side portion of hand, wherein a side of the glove component is adhered on a surface of the glove core, the glove component covers a part of the palm portion and a part of the dorsum portion of the glove core, a part of the palm portion and a part of the side portion of hand of the glove core, or a part of the dorsum portion and a part of the side portion of hand of the glove core, and wherein the glove component includes a first glove component and a second glove component, the first glove component is provided with a first inner surface and a first outer surface opposite to the first inner surface, the second glove component is provided with a second inner surface and a second outer surface opposite to the second inner surface, and the second inner surface is adhered on the first outer surface by a combination region.

2. The glove according to claim 1, wherein that an adhesive layer is disposed between the glove core and the glove component to adhere the two.

3. The glove according to claim 1, wherein the surface of the glove core, not being covered by the glove component, is provided with a protection layer.

4. The glove according to claim 1, wherein the first glove component is connected together with the second glove component by a connection portion.

5. The glove according to claim 1, wherein the first inner surface and the second inner surface form a holding space.

6. The glove according to claim 1, wherein the glove component includes a third glove component, wherein the third glove component is adhered with a first glove component or the second glove component by a combination region.

7. The glove according to claim 1, wherein the glove component includes a third glove component, wherein the first inner surface and the second inner surface form a holding space, and the third glove component is adhered with the first glove component or the second glove component by a combination region.

8. A glove, comprising a glove core and a glove component, with the glove core including a palm portion, a dorsum portion and a finger portion, wherein a side of the glove component is adhered on a surface of the glove core, the glove component covers a part of the palm portion and a part of the dorsum portion of the glove core, a part of the finger portion, or a part of the palm portion, a part of the dorsum portion and a part of the finger portion, and wherein the glove component includes a first glove component and a second glove component, with that the first glove component is provided with a first inner surface and a first outer surface opposite to the first inner surface, the second glove component is provided with a second inner surface and a second outer surface opposite to the second inner surface, and the second inner surface is adhered with the first outer surface by a combination region.

9. The glove according to claim 8, wherein the finger portion further includes a thumb sleeve, an index finger sleeve, a middle finger sleeve, a ring finger sleeve, a little finger sleeve, a web space disposed between the thumb sleeve and the index finger sleeve, and three fork portions disposed among the index finger sleeve, the middle finger sleeve, the ring finger sleeve and the little finger sleeve, with the glove component covering the web space and a part of the fork portions being sewn on a surface of the glove core.

10. The glove according to claim 8, wherein an adhesive layer is disposed between the glove core and the glove component to adhere the two.

11. The glove according to claim 8, wherein the surface of the glove core, not being covered by the glove component, is provided with a protection layer.

12. The glove according to claim 8, wherein the first glove component is connected with the second glove component by a connection portion.

13. The glove according to claim 8, wherein the first inner surface and the second inner surface form a holding space.

14. The glove according to claim 8, wherein the glove component includes a third glove component, wherein the third glove component is adhered with the first glove component or the second glove component by a combination region.

15. The glove according to claim 8, wherein the glove component includes a third glove component, wherein the first inner surface and the second inner surface form a holding space, and the third glove component is adhered with the first glove component or the second glove component by a combination region.

16. A glove, comprising:

a glove core, comprising:

a palm portion;

a dorsum portion; and a side portion of hand; and a glove component, wherein a side of the glove component is adhered on a surface of the glove core, the glove component covers a part of the palm portion and a part of the dorsum portion of the glove core, a part of the palm portion and a part of the side portion of hand of the glove core, or a part of the dorsum portion and a part of the side portion of hand of the glove core, wherein the glove component includes a first glove component and a second glove component, wherein the first glove component is provided with a first inner surface, a first outer surface opposite to the first inner surface, and a first cross section disposed between the first inner surface and the first outer surface, and wherein the second glove component being provided with a second inner surface, a second outer surface opposite to the second inner surface, and a second cross section disposed between the second inner surface and the second outer surface, with the first cross section being adhered with the second cross section by a combination region.

17. A glove, comprising:

a glove core, comprising:

a palm portion;

a dorsum portion; and a finger portion; and a glove component, wherein a side of the glove component is adhered on a surface of the glove core, the glove component covers a part of the palm portion and a part of the dorsum portion of the glove core, a part of the finger portion, or a part of the palm portion, a part of the dorsum portion and a part of the finger portion, wherein the glove component includes a first glove component and a second glove component, wherein the first glove component is provided with a first inner surface, a first outer surface opposite to the first inner surface, and a first cross section disposed between the first inner surface and the first outer surface, and wherein the second glove component being provided with a second inner surface, a second outer surface opposite to the second inner surface, and a second cross section disposed between the second inner surface and the second outer surface, with the first cross section being adhered with the second cross section by a combination region.

* * * * *